US006643873B2

(12) United States Patent
Heimbrock et al.

(10) Patent No.: US 6,643,873 B2
(45) Date of Patent: Nov. 11, 2003

(54) PATIENT SUPPORT APPARATUS HAVING AUTO CONTOUR

(75) Inventors: Richard H. Heimbrock, Cincinnati, OH (US); Jonathan D. Turner, Dillsboro, IN (US); Kenneth W. Meyer, Batesville, IN (US); Bernard F. Voegele, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 10/119,470

(22) Filed: Apr. 10, 2002

(65) Prior Publication Data

US 2002/0157185 A1 Oct. 31, 2002

Related U.S. Application Data

(60) Provisional application No. 60/287,347, filed on Apr. 27, 2001.

(51) Int. Cl.[7] ..... A47B 7/02
(52) U.S. Cl. ..... 5/618; 5/617
(58) Field of Search ..... 5/617, 618

(56) References Cited

U.S. PATENT DOCUMENTS

| | | | | |
|---|---|---|---|---|
| 2,520,849 A | | 8/1950 | McVicker | |
| 2,722,017 A | | 11/1955 | Burst et al. | |
| 3,094,713 A | | 6/1963 | Wise | |
| 3,184,765 A | | 5/1965 | Katz | |
| 3,237,212 A | * | 3/1966 | Hillenbrand et al. | 5/616 |
| 3,253,285 A | | 5/1966 | Fox | |
| 3,323,145 A | | 6/1967 | Willer et al. | |
| 3,353,193 A | | 11/1967 | Greiner | |
| 3,506,989 A | | 4/1970 | Ross et al. | |
| 3,585,659 A | | 6/1971 | Burst et al. | |
| 3,665,528 A | | 5/1972 | Kjellberg et al. | |
| 3,724,003 A | | 4/1973 | Ellwanger et al. | |
| 3,797,050 A | | 3/1974 | Benoit et al. | |
| 3,821,821 A | | 7/1974 | Burst et al. | |
| 3,840,911 A | | 10/1974 | Benoit et al. | |
| 3,965,500 A | | 6/1976 | Stein, Jr. | |
| 4,025,972 A | | 5/1977 | Adams et al. | |
| 4,044,286 A | | 8/1977 | Adams et al. | |
| 4,097,939 A | | 7/1978 | Peck et al. | |
| 4,097,940 A | | 7/1978 | Tekulve et al. | |
| 4,398,313 A | | 8/1983 | Mitchell | |
| 4,425,674 A | | 1/1984 | Werner | |
| 4,472,845 A | | 9/1984 | Chivetta et al. | |
| 4,489,449 A | | 12/1984 | Failor et al. | |

(List continued on next page.)

FOREIGN PATENT DOCUMENTS

| | | |
|---|---|---|
| DE | 3444448 A1 | 6/1986 |
| DE | 3615223 A1 | 4/1987 |
| DE | 3618680 A1 | 12/1987 |
| DE | 19654110 C1 | 1/1998 |
| EP | 0 657 154 A2 | 6/1995 |
| EP | 0 852 123 A1 | 7/1998 |
| FR | 2 555 426 A1 | 5/1985 |
| FR | 2 635 681 A1 | 3/1990 |
| FR | 2 711 521 A1 | 5/1995 |
| GB | 2345 439 A | 7/2000 |

OTHER PUBLICATIONS

Brochure Introducing The Resident™ LTC Bed, Hill–Rom, 1996.

*Primary Examiner*—Teri Pham Luu
(74) *Attorney, Agent, or Firm*—Barnes & Thornburg

(57) ABSTRACT

A patient support apparatus includes a frame and a deck carried on the frame. The deck includes longitudinally-spaced apart and transversely-extending back, seat, thigh and foot sections, with at least the back, thigh and foot sections articulated relative to the frame. A back section drive is coupled to the back section to raise and lower the back section. A thigh section drive coupled to the back section and the thigh section to initially raise and then lower the thigh section as the back section is raised.

49 Claims, 14 Drawing Sheets

U.S. PATENT DOCUMENTS

| | | | |
|---|---|---|---|
| 4,559,655 | A | 12/1985 | Peck |
| 4,579,381 | A | 4/1986 | Williams |
| 4,627,120 | A | 12/1986 | Harris |
| 4,776,047 | A | 10/1988 | DiMatteo |
| 4,821,351 | A | 4/1989 | Bergenwall |
| 4,847,929 | A | 7/1989 | Pupovic |
| 4,945,582 | A | 8/1990 | Hayton et al. |
| 4,947,496 | A | 8/1990 | Connolly |
| 4,985,946 | A | 1/1991 | Foster et al. |
| 4,993,089 | A | 2/1991 | Solomon et al. |
| 5,063,624 | A | 11/1991 | Smith et al. |
| 5,105,486 | A | 4/1992 | Peterson |
| 5,138,646 | A | 8/1992 | Hubert et al. |
| 5,161,274 | A | 11/1992 | Hayes et al. |
| 5,179,746 | A | 1/1993 | Rogers |
| 5,205,004 | A | 4/1993 | Hayes et al. |
| 5,303,437 | A | 4/1994 | Hung |
| 5,317,769 | A | 6/1994 | Weismiller et al. |
| 5,317,770 | A | 6/1994 | Sakurai |
| 5,369,825 | A | 12/1994 | Reesby |
| 5,377,372 | A | 1/1995 | Rudolf et al. |
| 5,398,357 | A | 3/1995 | Foster |
| 5,444,880 | A | 8/1995 | Weismiller et al. |
| 5,500,964 | A | 3/1996 | Bergersen |
| 5,537,701 | A | 7/1996 | Elliott |
| 5,577,280 | A | 11/1996 | Elliott |
| 5,611,096 | A | 3/1997 | Bartlett et al. |
| 5,708,997 | A | 1/1998 | Foster et al. |
| 5,832,549 | A | 11/1998 | Le Pallec et al. |
| 5,862,551 | A | 1/1999 | Oguma et al. |
| 5,870,784 | A | 2/1999 | Elliott |
| 5,878,452 | A | 3/1999 | Brooke et al. |
| 5,987,671 | A | 11/1999 | Heimbrock et al. |
| 6,000,076 | A | 12/1999 | Webster et al. |
| 6,006,379 | A | 12/1999 | Hensley |
| 6,016,580 | A | 1/2000 | Heimbrock et al. |
| 6,073,286 | A | 6/2000 | Wu |
| 6,076,209 | A | 6/2000 | Paul |
| 6,076,210 | A | 6/2000 | Wu |
| 6,101,649 | A | 8/2000 | Wu |
| 6,108,839 | A | 8/2000 | Wu |
| 6,230,346 | B1 | 5/2001 | Branson et al. |
| 6,351,861 | B1 | 3/2002 | Shows et al. |

* cited by examiner

PATIENT SUPPORT APPARATUS HAVING AUTO CONTOUR

This application claims the benefit of U.S. Provisional Patent Application, Ser. No. 60/287,347, filed on Apr. 27, 2001, and entitled "Patient Support Apparatus Having Auto Contour".

BACKGROUND AND SUMMARY OF THE INVENTION

The present invention generally relates to a patient support apparatus, such as a hospital bed or a stretcher, having articulating back, thigh and foot sections. More particularly, the present invention relates to a patient support apparatus having an auto contour feature so that the knees of the patient supported on the patient support apparatus are raised and lowered as the back section is raised and lowered.

Stretchers often do not have a knee crank mechanism, and therefore the knees of the patient supported on the stretcher cannot be raised from a generally horizontal position. Because the patient's knees cannot be raised when the patient's head is raised, the patient has a tendency to migrate toward the foot end of the stretcher. Even in stretchers with a knee crank mechanism, the caregiver must raise the patient's knees separately from the patient's head. Because caregivers are often in a hurry, the patient's knees do not always get raised and when they don't, the patient may slide toward the foot end of the stretcher. Eventually the patient's feet may extend past the foot end of the stretcher. When a caregiver tries to reposition a patient back toward the head end of the stretcher, there is a risk of back injury to the caregiver.

Although the term "stretcher" is used throughout the specification of the present patent application, it is understood that the novel features of the invention may as well be incorporated into any type of patient support apparatus, such as a hospital bed, an ambulatory chair, an x-ray table, an operating table and so on. The term "patient support apparatus" as used in this description and claims shall therefore be understood to include any type of patient support apparatus, such as s stretcher, a hospital bed, an ambulatory chair, an x-ray table or an operating table.

According to the present invention, a patient support apparatus includes a frame and a deck carried on the frame. The deck includes back, seat and thigh sections, with at least the back and thigh sections articulated relative to the frame. A back section drive is coupled to the back section to raise and lower the back section. A thigh section drive is coupled to the back section and to the thigh section to raise and lower the thigh section as the back section is raised and lowered. The back section drive includes a control coupled to the back section near the head end thereof that can be actuated to adjust the position of the back section relative to the frame.

According to an illustrative embodiment, a patient support apparatus includes a frame and a deck carried on the frame. The deck includes back, seat and thigh sections, with at least the back and thigh sections articulated relative to the frame. A back section drive is coupled to the back section to raise and lower the back section. A thigh section drive is coupled to the thigh section to raise and lower the thigh section. The back section drive and the thigh section drive are operatively coupled together such that the thigh section is initially raised and then lowered as the back section is raised from a horizontal position to a near upright position through an intermediate position therebetween.

According to another illustrative embodiment, a patient support apparatus includes a frame and a deck carried on the frame. The deck includes back, seat and thigh sections, with at least the back and thigh sections articulated relative to the frame. A back section drive is coupled to the back section to raise and lower the back section. A thigh section drive is coupled to the back section and the thigh section to initially raise and then lower the thigh section as the back section is raised.

In the illustrative patient support apparatus, the thigh section drive includes a track coupled to the frame and a track-engaging member movable along the track and coupled to the thigh section and coupled to the back section. The track includes a first straight portion along which the track-engaging member moves to raise the thigh section and a second inclined portion along which the track-engaging member moves to lower the thigh section as the back section is raised. The track-engaging member may be a roller.

The illustrative patient support apparatus includes linkage coupling the track-engaging member to the back section to move the track-engaging member along the track initially along the straight portion to raise the thigh section and then along the inclined portion to lower the thigh section as the back section is raised. The linkage includes a spring clutch comprising a housing, coil gripping springs received inside the housing and a connecting rod. The connecting rod has a first end coupled to the back section for pivoting movement by a pivot pin and a second end slidably received inside the gripping springs. The spring clutch is lockable so that the gripping springs constricts around the connecting rod preventing the connecting rod from sliding relative to the clutch housing to couple the back section to the track-engaging member so that the thigh section is initially raised and then lowered as the back section is raised. The spring clutch is releasable so that the gripping springs loosens its grip on the connecting rod allowing the connecting rod to slide relative to the clutch housing to decouple the back section from track-engaging member so that the back section can be raised without also raising the thigh section.

The illustrative patient support apparatus includes a handle coupled to the spring clutch, and movable between a first position where the spring clutch is locked to couple the back section to the track-engaging member and a second position where the spring clutch is released to decouple the back section from the track-engaging member. A clutch release rod is coupled to the handle. A clutch release cable couples the clutch release rod to the spring clutch so that the spring clutch is locked when the handle is moved from the second position to the first position and the spring clutch is unlocked when the handle is moved from the first position to the second position. A latch plate is coupled to the back section and coupled to the clutch release rod for locking the clutch release rod when the back section is raised and freeing the clutch release rod when the back section is lowered to a horizontal or near horizontal position.

According to still another illustrative embodiment, a patient support apparatus includes a frame and a deck carried on the frame. The deck includes back, seat and thigh sections, with at least the back and thigh sections articulated relative to the frame. A first thigh section drive is coupled to the back section and to the thigh section to initially raise and then lower the thigh section as the back section is raised. A second thigh section drive is coupled to the thigh section to raise and lower the thigh section when the first thigh section drive is decoupled from the back section.

Additional features and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF DRAWINGS

Figure 1:
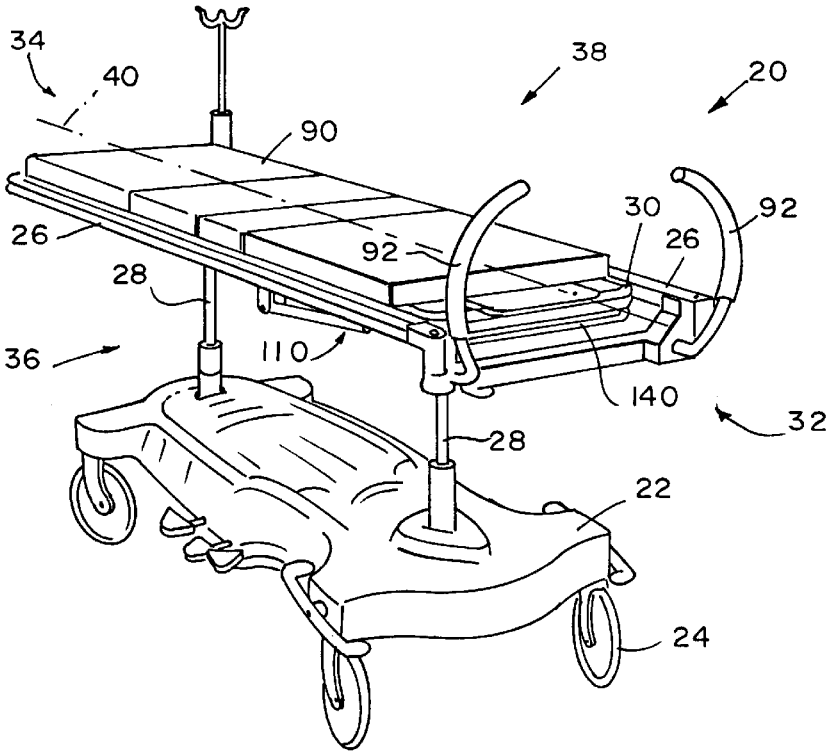
FIG. 1 is a perspective view of an illustrative stretcher including a base supported on casters, a frame coupled to the base by an elevation mechanism, a deck coupled to the frame, a pair of push bars positioned near the head end, the deck including transversely-extending back, seat, thigh and foot sections with the back, thigh and foot sections articulated relative to the frame, the illustrative stretcher including a back section drive (also referred to herein as the actuator) coupled to the back section to raise and lower the back section, an auto contour mechanism (also referred to herein as the first thigh section drive) coupled to the back section and the thigh section to initially raise and then lower the thigh section as the back section is raised, and a knee crank mechanism (also referred to herein as the second thigh section drive) coupled to the thigh section to raise and lower the thigh section when the first thigh section drive is decoupled from the back section.

Referring to FIGS. 1–5, an illustrative stretcher 20 (sometimes referred to as patient support apparatus) includes a base 22 supported on casters 24, a frame 26 coupled to the base 22 by an elevation mechanism 28, a patient support deck 30 coupled to the frame 26, a head end 32, a foot end 34, an elongated first side 36, an elongated second side 38, and a longitudinal axis 40. As used in this description, the phrase "head end 32" will be used to denote the end of any referred-to object that is positioned to lie nearest the head end 32, and the phrase "foot end 34" will be used to denote the end of any referred-to object that is positioned to lie nearest the foot end 34. Likewise, the phrase "first side 36" will be used to denote the side of any referred-to object that is positioned to lie nearest the first side 36, and the phrase "second side " will be used to denote the side of any referred-to object that is positioned to lie nearest the second side 38.

Figure 12:
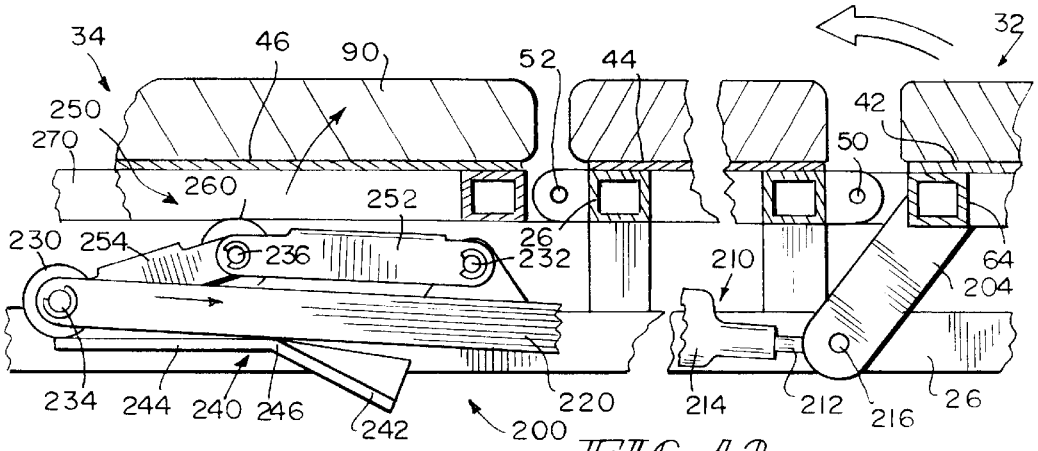
Figure 13:
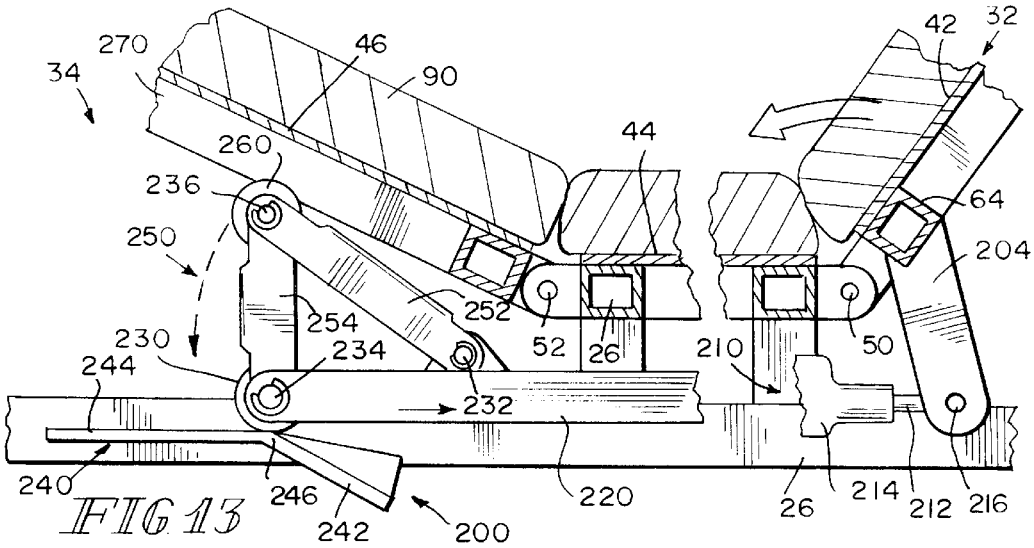
Figure 14:
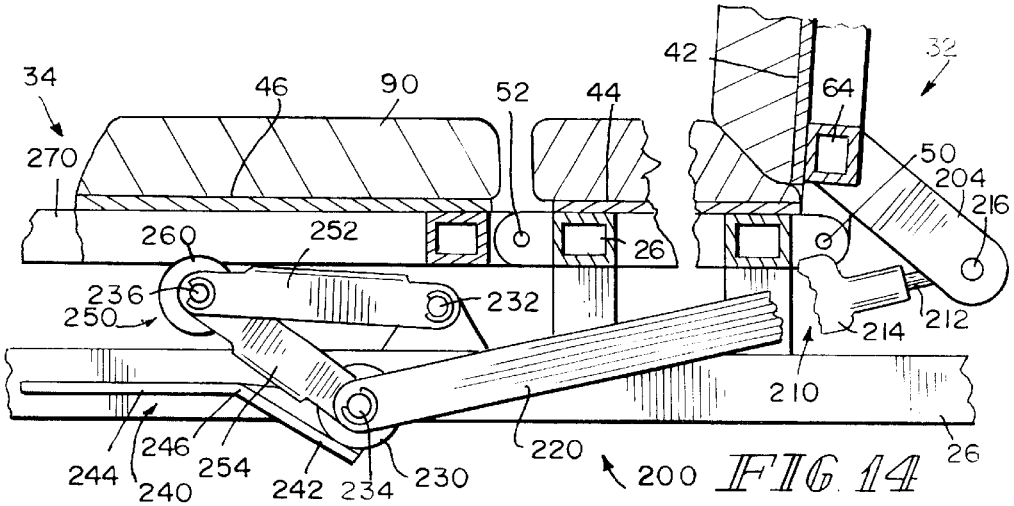
Figures 15, 21, 22:
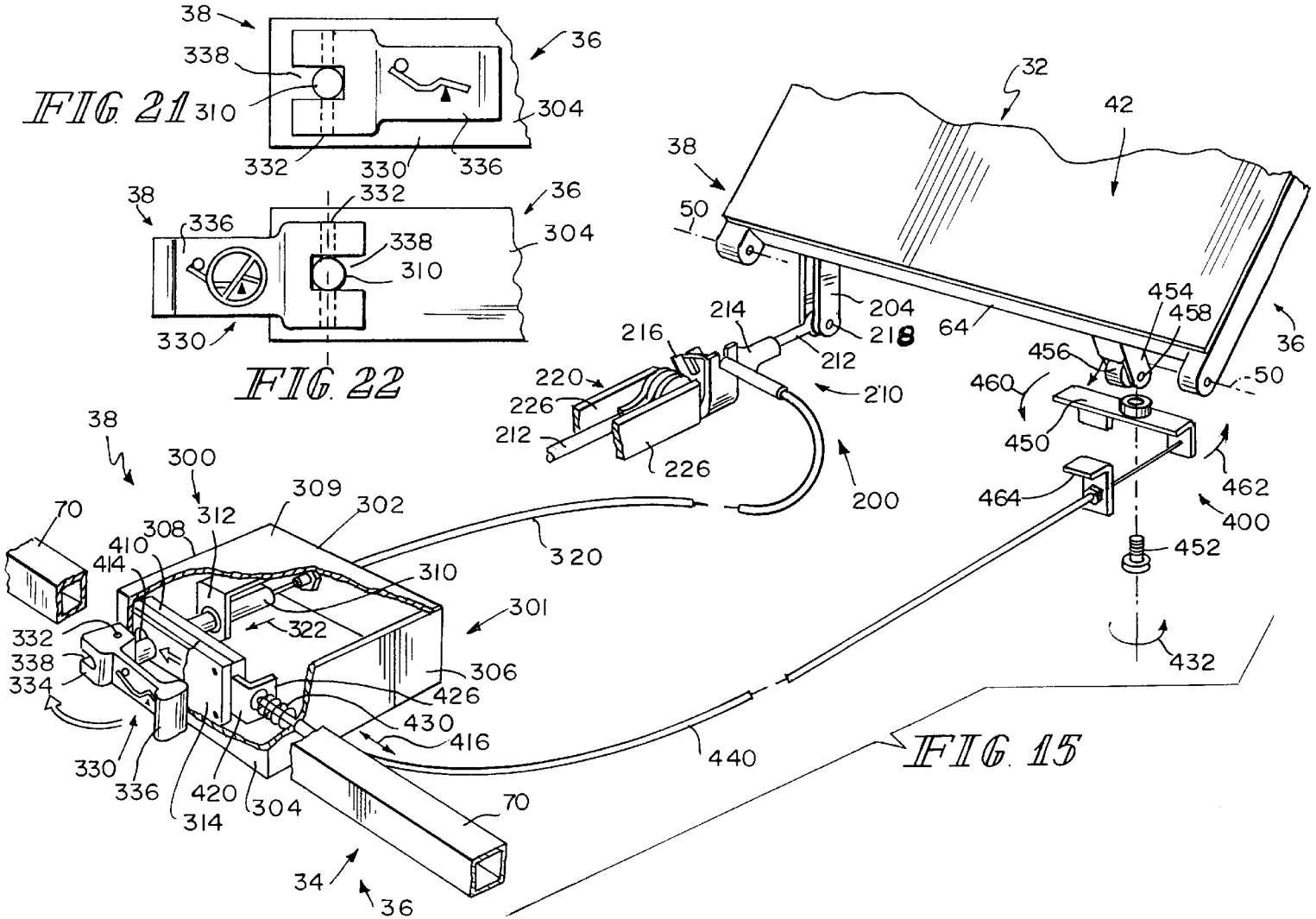
FIG. 15 is a partial perspective view with portions broken away, and showing an auto contour disabling mechanism (also referred to as the first thigh section drive disabling mechanism) including a clutch release rod translatably mounted to the frame, a clutch release cable coupling the clutch release rod to the spring clutch and a flip-over handle coupled to the clutch release rod and movable side-to-side between first and second positions, and further showing an auto contour locking mechanism (also referred to as the first thigh section drive locking mechanism) including a latch plate translatably mounted to the frame and configured to engage one of two grooves in the clutch release rod to lock the flip-over handle in one of two positions when the back section is raised, and a safety lock cable coupling the latch plate to a rocker arm actuated by the back section to retract the latch plate to free the flip-over handle when the back section is lowered to a horizontal position.
FIG. 21 is an end view showing the flip-over handle moved to the first position where the auto contour mechanism is enabled.
FIG. 22 is an end view similar to FIG. 21, and showing the flip-over handle moved to the second position where the auto contour mechanism is disabled.

The deck 30 includes longitudinally-spaced apart and transversely-extending back, seat, thigh and foot sections 42–48. The back, seat, thigh and foot sections 42–48 of the deck 30 define an upwardly-facing support surface for supporting a mattress 90. The mattress 90 includes back, seat, leg and foot sections that are sized to cover the respective back, seat, leg and thigh sections 42–48 of the deck 30. The seat section 44 is fixed to the frame 26. The back section 42 is pivotally coupled to the frame 26 adjacent to the head end 32 of the seat section 44 for rotation about a first transverse pivot axis 50 as shown in FIGS. 12–14. The thigh section 46 is pivotally coupled to the frame 26 adjacent to the foot end 34 of the seat section 44 for rotation about a second transverse pivot axis 52 as shown in FIGS. 12–14. The back section 42 and the thigh section 46 may, however, be pivotally coupled to the seat section 44 adjacent to the opposite ends 32, 34 of the seat section 44 for rotation about the pivot axes 50, 52. The foot section 48 is pivotally coupled to the thigh section 46 adjacent to the foot end 34 thereof for rotation about a third transverse pivot axis 54 as shown in FIG. 22. The foot end 34 of the foot section 48 is pivotally coupled to the frame 26 by a generally u-shaped rocker frame 80 shown in FIGS. 5–7. When the thigh section 46 is raised, the foot section 48 is raised therewith to lift the knees of the patient supported on the mattress 90.

Figure 5:
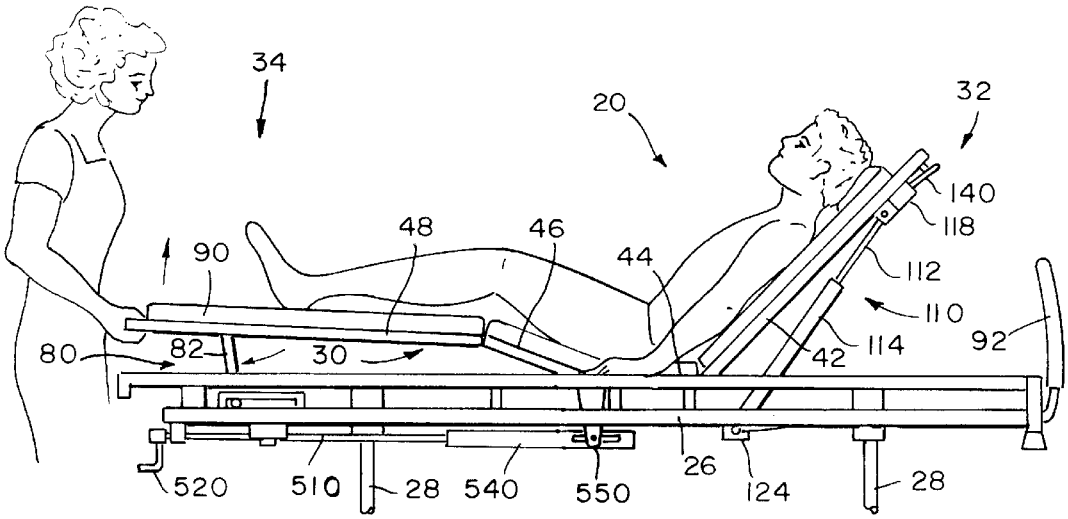
FIG. 5 is an elevation view similar to FIGS. 2–4, with the caregiver standing near the foot end of the stretcher, and lifting the foot section to raise the feet of the patient.
Figure 6:
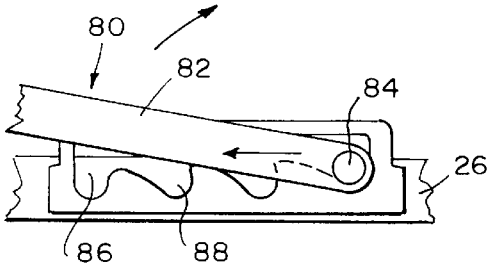
FIGS. 6 and 7 are elevation views illustrating the operation of a rocker frame pivotally coupled to the foot section near the foot end to manually adjust the position of the foot section of the stretcher.
Figure 7:
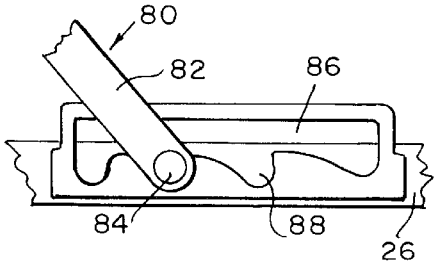

Referring to FIGS. 5–7, the generally u-shaped rocker frame 80 includes a pair of transversely-spaced vertically-extending members 82 joined by a transversely-extending member 84. Upper ends of the vertically-extending members 82 are pivotally coupled to the foot section 48 near the free end 34 thereof. The opposite ends of the transversely-extending member 84 are configured to be received in a pair of transversely-spaced longitudinally-extending slots 86 in the frame 26. The slots 86 include a plurality of transversely-extending notches 88 along the lower walls thereof for releasably receiving the transversely-extending member 84. As shown in FIG. 5, the transversely-extending member 84 is manually adjustable along the slots 86 to lift the foot section 48 to various positions of elevation. The closer the transversely-extending member 84 to the foot end 34, the higher the elevation of the foot section 48 as shown in FIG. 5.

Figure 8:
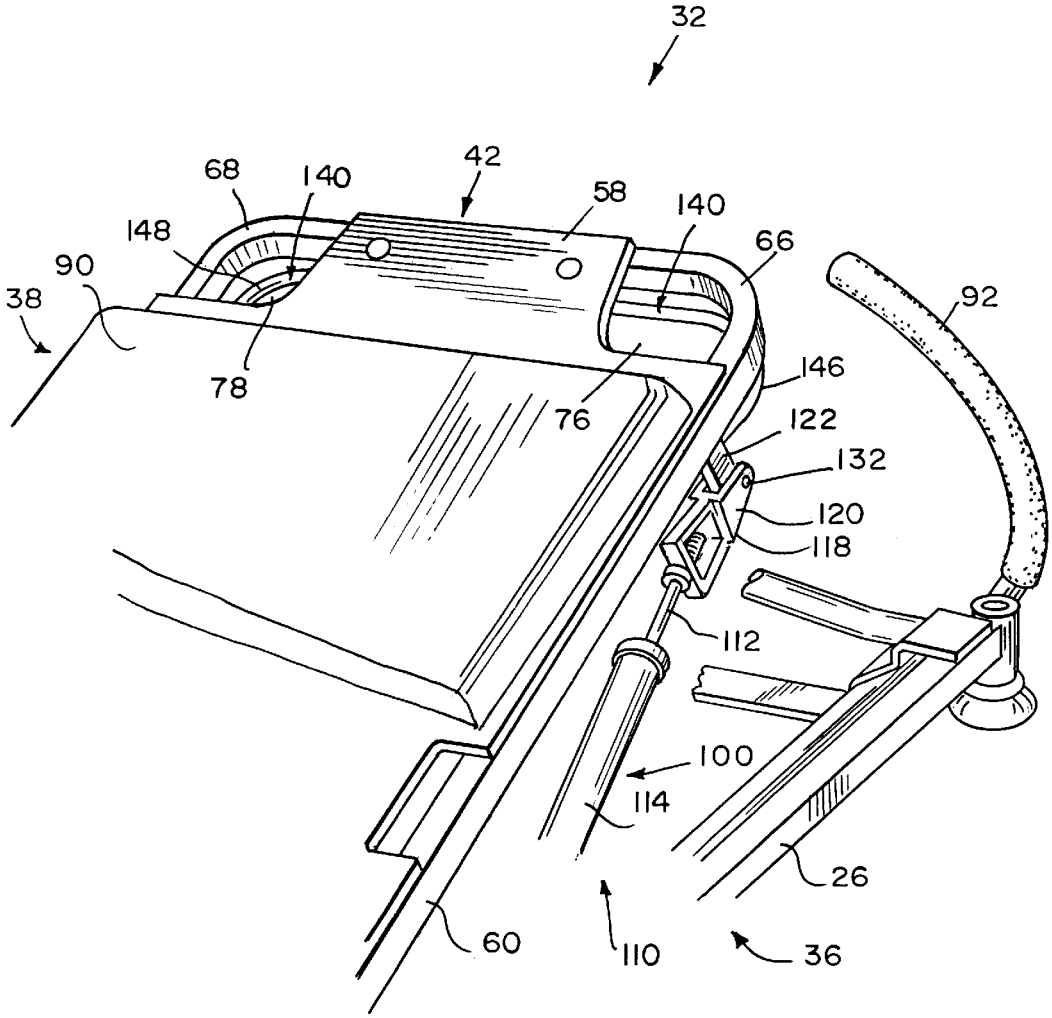
FIGS. 8–10 are partial perspective views showing the back section drive including a pair of normally-locked actuators disposed on opposite sides of the stretcher, and a release bar positioned near the head end of the stretcher and coupled to the actuators.
Figure 9:
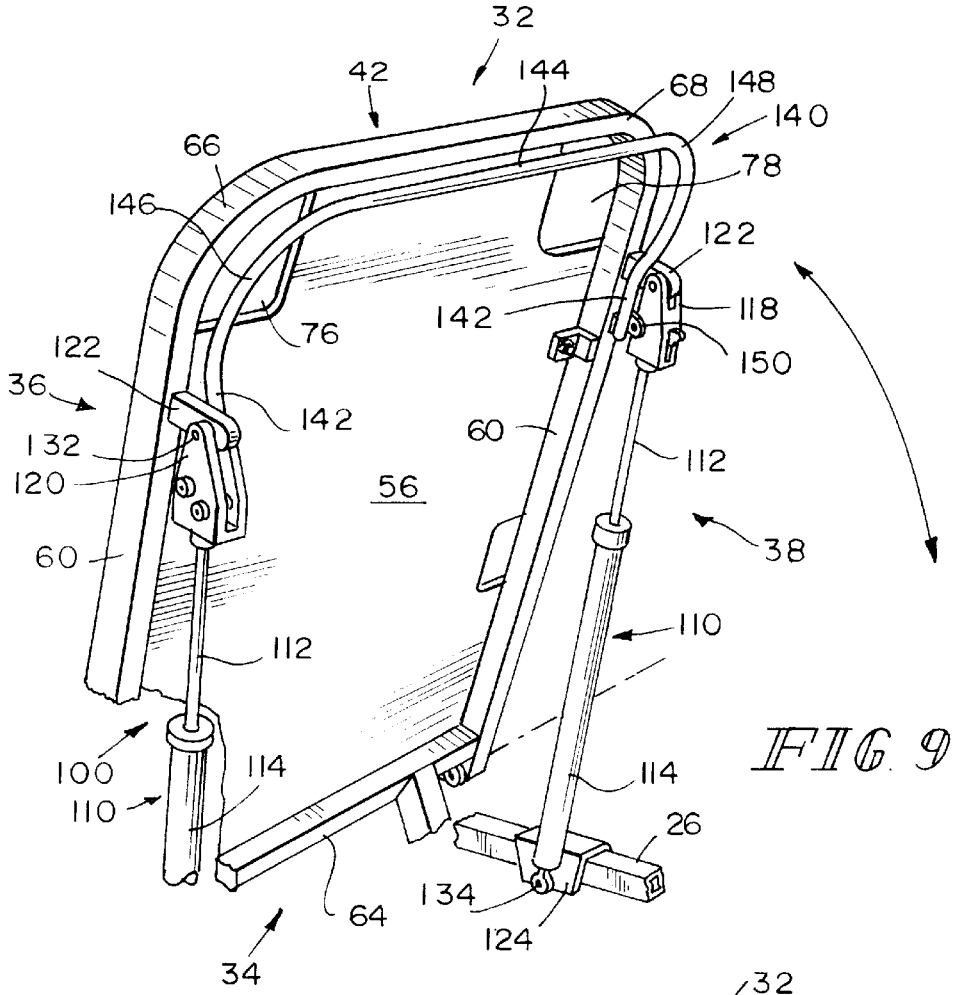
Figure 10:
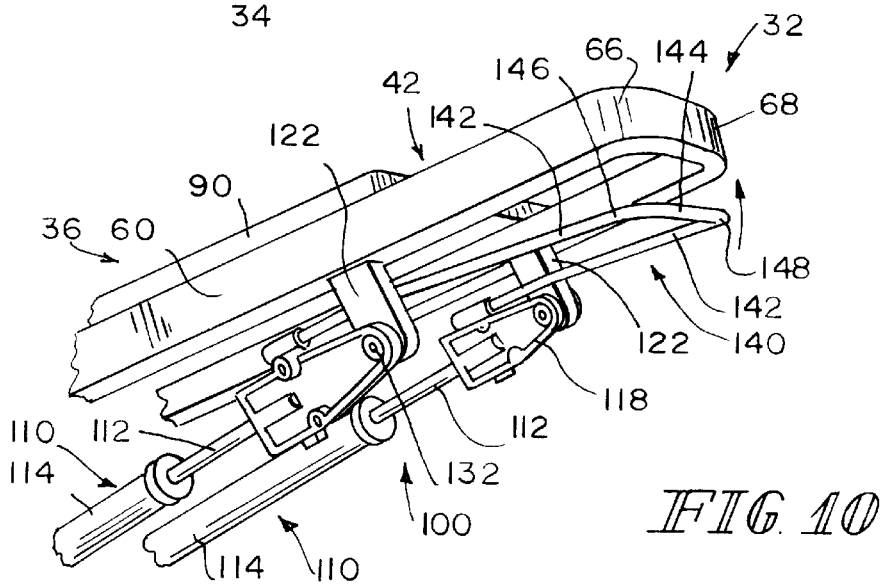
Figure 11:
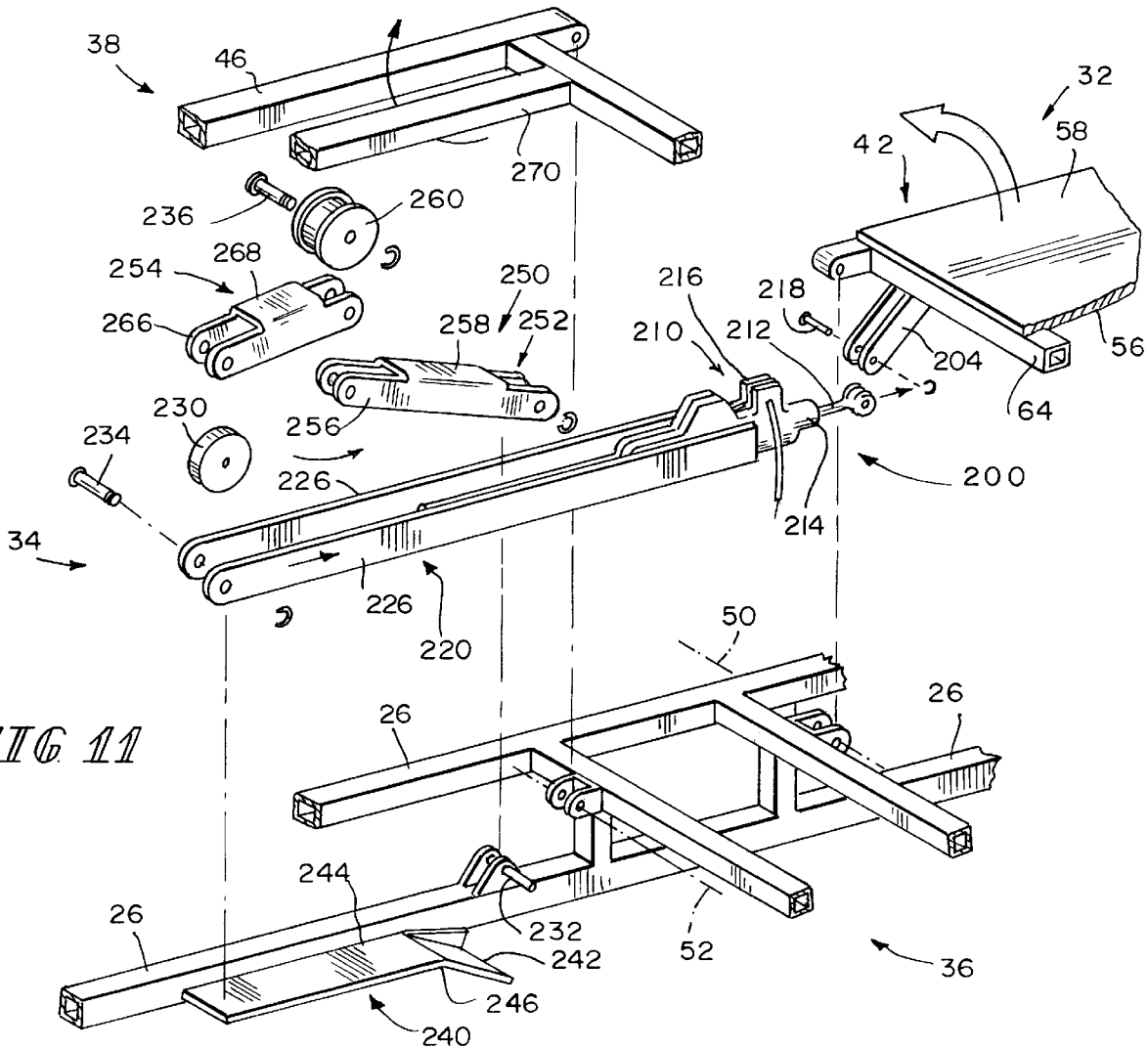
FIG. 11 is an exploded perspective view of the auto contour mechanism including a spring clutch coupling the back section to a longitudinally-extending bracket, a track-engaging roller coupled to the longitudinally-extending bracket, a track coupled to the stretcher frame for supporting the roller and having a first generally horizontal portion and a second generally inclined portion and a center pivoting linkage coupled to the track-engaging roller and configured to engage the thigh section to initially raise and then lower the thigh section as the back section is raised from a horizontal position to a near upright position through an intermediate position therebetween as shown in FIGS. 2–4, FIGS. 12–14 are sectional elevation views corresponding to FIGS. 2–4 and illustrating the operation of the auto contour mechanism, FIG. 12 showing the back, seat and thigh sections disposed horizontally, FIG. 13 showing the back section lifted to an intermediate raised position and the thigh section lifted to a raised position, FIG. 14 showing the back section lifted to a near upright position and the thigh section lowered to a horizontal position.

The stretcher 20 includes first and second push bars 92 positioned on opposite sides 36, 38 of the stretcher 20 as shown in FIG. 1. The push bars 92 can be swung to their respective out-of-the-way down positions so that a caregiver can have access to a patient supported on the stretcher 20. As shown in FIGS. 8–10, the back section 42 includes a generally rectangular panel 58 attached to a tubular frame member 60. The frame member 60 includes a transversely-extending base strut 64 adjacent to the foot end 34, and rounded corner portions 66, 68 on opposite sides 36, 38 adjacent to the head end 32. The panel 58 includes cutouts 76, 78 adjacent to the corner portions 66, 68 of the frame member 60 so that a caregiver can have access to a back section release bar 140 situated below the back section 42 adjacent to the head end 32 to adjust the position of the back section 42.

Figure 23:
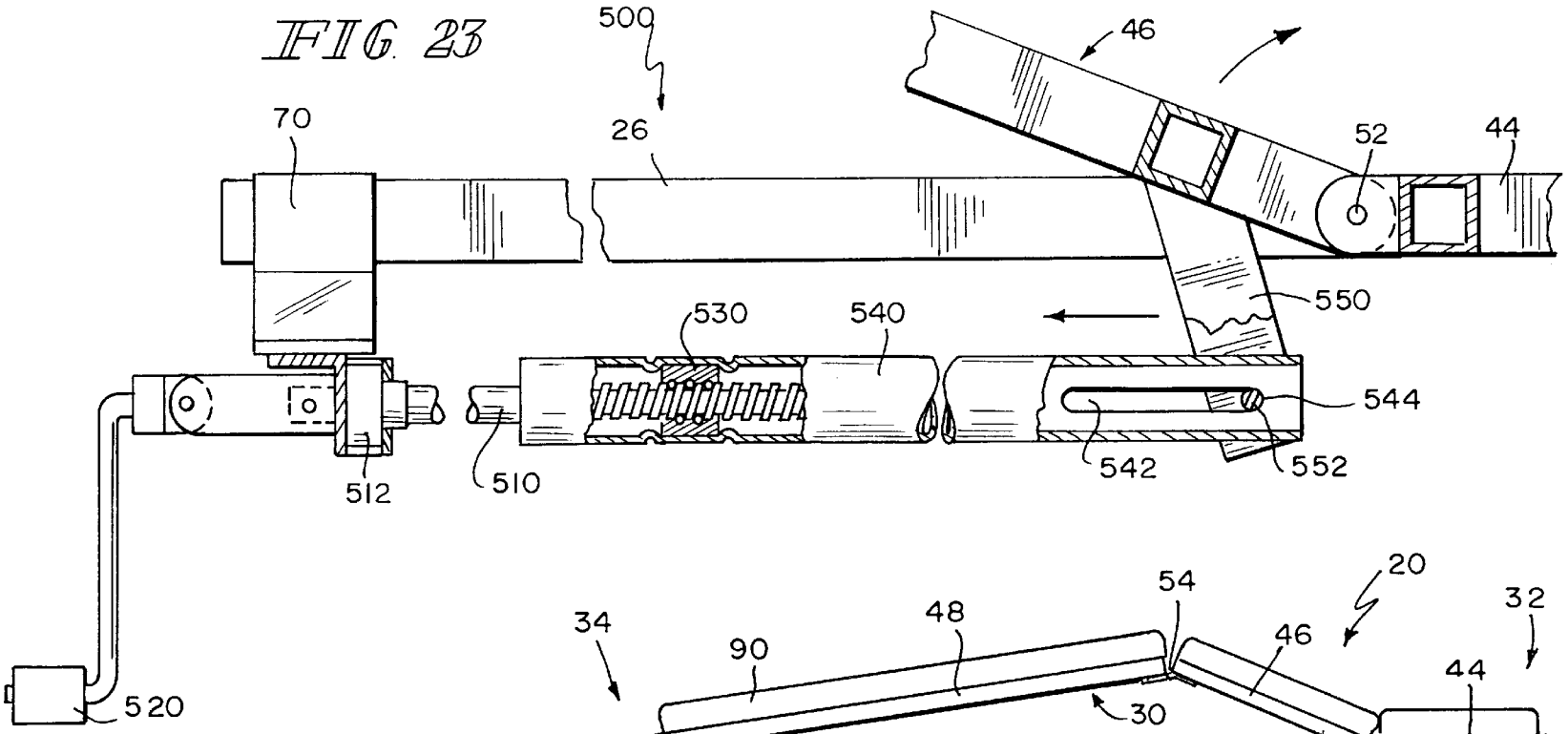
FIG. 23 is an end view, partly in section, of the knee crank mechanism, and showing a longitudinally-extending ball screw rotatably mounted to the frame, a crank coupled to the foot end of the ball screw, the head end of the ball screw received in a nut crimped inside a longitudinally-extending tube, the longitudinally-extending tube having a transversely-extending elongated slot receiving a transversely-extending pivot pin secured to a downwardly-depending arm appended to the underside of the thigh section.
Figure 24:
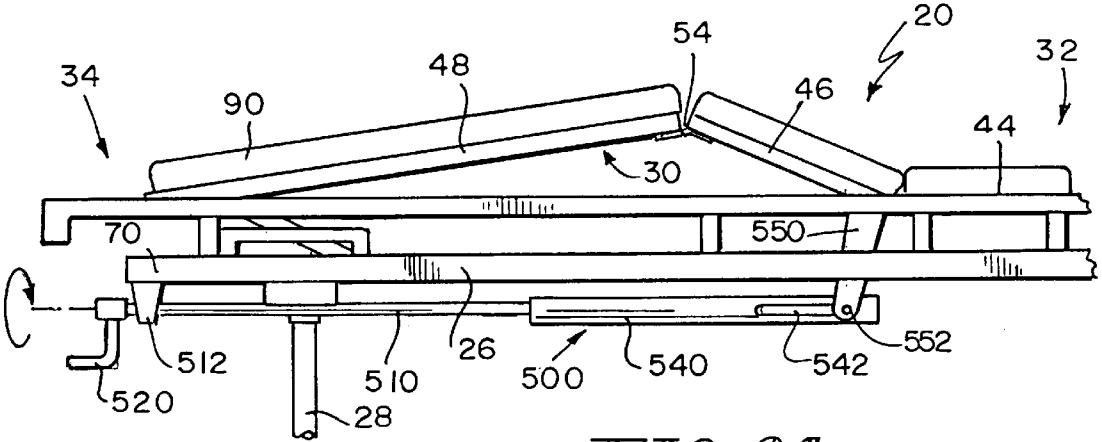
FIG. 24 is an end view corresponding to FIG. 23, and showing the operation of the knee crank mechanism.

The illustrative stretcher 20 includes: a) a back section drive 100 (also referred to herein as the actuator) coupled to the back section 42 to raise and lower the back section 42 as shown in FIGS. 8–10, b) an auto contour mechanism 200 (also referred to as the first thigh section drive) coupled to the back section 42 and the thigh section 46 to initially raise and then lower the thigh section 46 when the back section 42 is raised from a horizontal position to a near upright position through an intermediate position therebetween as shown in FIGS. 11–15, c) an auto contour enabling/disabling mechanism 300 (also referred to as the auto contour disabling mechanism or the first thigh section drive disabling mechanism) that selectively disables the auto contour mechanism 200 so that the back section 42 can be raised without also lifting the thigh section 46 as shown in FIGS. 15–22, d) an auto contour locking mechanism 400 (also referred to as the first thigh section drive locking mechanism) that prevents operation of the auto contour enabling/disabling mechanism 300 when the back section 42 is raised as shown in FIGS. 15–22, and e) a knee crank mechanism 500 (also referred to as the second thigh section drive) that allows the thigh section 46 to be raised and lowered independently of the auto contour mechanism 200 as shown in FIGS. 23 and 24. Throughout this description, the terms "enabling mechanism", "disabling mechanism" and "enabling/disabling mechanism" are used interchangeably. Thus, the auto contour disabling mechanism is sometimes referred to as the auto contour enabling/disabling mechanism. Also, throughout this description, the terms "auto contour mechanism" and "first thigh section drive" are used interchangeably.

Referring to FIGS. 8–10, the back section drive 100 includes a pair of actuators 110, one on each side 36, 38 of the back section 42. In the illustrated stretcher 20, both the actuators 110 are gas springs. It is, however, within the scope of the invention as presently perceived for the actuators 110 to include any suitable locking mechanism that can be locked to prevent movement of the actuators 110, and that can be released to allow extension and retraction of the actuators 110. Thus, the term "actuator" as used in this specification and in the claims includes a gas spring, a spring clutch, a ball screw, a hydraulic cylinder, a pneumatic cylinder, or any other suitable mechanism that can be locked to prevent the back section 42 from pivoting relative to the frame 26, and that can be released to allow the back section 42 to be grabbed by the caregiver and manually pivoted relative to the frame 26.

The two gas springs 110 are identical. Each gas spring 110 includes a piston (not shown), a piston rod 112 coupled to the piston and a housing 114. The piston is received inside the housing 114, and the piston rod 112 extends out of the housing 114. The head end 32 of the piston rod 112 is coupled to a mounting bracket 118. The mounting bracket 118 includes a pair of transversely-spaced flanges 120 configured to form a slot for receiving a flange 122 appended to the underside of the frame member 60 of the back section 42 adjacent to the head end 32. The mounting bracket 118 is pivotally coupled to the flange 122 by a transversely-extending pivot pin 132. The foot end 34 of the housing 114 is formed to include an aperture that rotatably receives a transversely-extending pivot pin 134 secured to a bracket 124 appended to the frame 26 adjacent to the foot end 34 of the back section 42 as shown in FIG. 9.

The gas spring 110 can be locked so that the piston and piston rod 112 are generally fixed relative to the housing 114 of the gas spring 110 so that the piston rod 112 can neither extend out of the housing 114 nor retract into the housing 114, thereby preventing the back section 42 from pivoting relative to the frame 26. The gas spring 110 can also be released so that the piston can move and the piston rod 112 can extend and retract relative to the housing 114, thereby allowing the caregiver to grab the corner portions 66, 68 of the back section 42 and pivot the back section 42 relative to the frame 26, for example, to raise and lower a patient's head. The gas spring 110 includes a plunger (not shown) extending out of the piston rod 112 near the head end 32 thereof. The plunger has an extended locking position in which the gas spring 110 is locked to prevent the back section 42 from pivoting relative to the frame 26. The plunger has a retracted releasing position in which the gas spring 110 is released allowing the back section 42 to pivot relative to the frame 26. The plunger is typically biased into the extended locking position so that the back section 42 is normally locked in place.

A generally u-shaped release bar 140 (also referred to as back section release rod or control) is located under the back section 42 near the head end 32. The generally u-shaped release bar 140 includes a pair of transversely-spaced horizontally-extending members 142 joined by a transversely-extending member 144 having rounded corner portions 146, 148. Each horizontally-extending member 142 includes a free end attached to a rocker arm 150 pivotally coupled to the mounting bracket 118. The rocker arms 150 are, in turn, coupled to the plungers of the actuators 110. The release bar 140 is movable between a first locking position spaced apart from the underside 56 of the back section 42, and a second releasing position spaced closer to the underside 56 of the back section 42. The release bar 140 is normally biased in the first locking position. The release bar 140 can be grabbed by the caregiver and moved to the releasing position to, in turn, move the plunger from the extended locking position to the retracted releasing position to free the back section 42 to pivot relative to the stretcher frame 26.

The rounded corner portions 146, 148 of the release bar 140 generally follow the rounded contour of the adjacent corner portions 66, 68 of the frame member 60. The panel 58 of the back section 42 includes cutouts 76, 78 in the region adjacent to the corner portions 66, 68 so that the caregiver or the surgeon can simultaneously grasp one of corner portions 66, 68 of the frame member 60 and one of corner portions 146, 148 of the release bar 140 to squeeze the release bar 140 to unlock the back section 42. For example, the corner portion 146 can be squeezed toward the adjacent corner portion 66 of the frame member 60 to move the plunger from the extended locking position to the retracted releasing position or, alternatively, the corner portion 148 can be squeezed toward the adjacent corner portion 68 of the frame member 60 to move plunger from the extended locking position to the retracted releasing position. Thus, the release bar 140 under the back section 42 near the head end 32 provides the stretcher 20 with a control that can be actuated to adjust the position of the back section 42.

Referring to FIGS. 11–15, the auto contour mechanism 200 (also referred to herein as the first thigh section drive) includes a spring clutch 210 (also known as the mechloc device). The spring clutch 210 includes a connecting rod 212, a clutch housing 214 and a trigger plate 216. A pair of transversely-spaced downwardly-extending flanges 204 are appended to the base strut 64 near the foot end 34 of the back section 42 adjacent to the second side 38. The head end 32 of the connecting rod 112 is coupled to the transversely-spaced flanges 204 for pivoting movement by a pivot pin 218. When the back section 42 is raised, the downwardly-extending flanges 204 cause the connecting rod 212 to move in the longitudinal direction 40 toward the head end 32 as shown in FIGS. 12–14. When the back section 42 is instead lowered, the downwardly-extending flanges 204 cause the connecting rod 212 to move in the longitudinal direction 40 toward the foot end 34.

The spring clutch 210 includes coil gripping springs (not shown) received inside the clutch housing 214. The gripping springs defines an interior region (not shown) slidably receiving the foot end 34 of the connecting rod 212. When the trigger plate 216 is in a first locking position, the spring clutch 210 is locked or engaged so that the gripping springs constricts around the connecting rod 212 preventing the connecting rod 212 from sliding relative to the clutch housing 214 and the gripping springs. When the trigger plate 216 is in a second releasing position, the spring clutch 210 is released or disengaged so that the coil gripping springs loosens its grip on the connecting rod 212 allowing the connecting rod 212 to slide relative to the clutch housing 214 and the coil gripping springs.

Although a spring clutch 210 is used in the illustrated stretcher 20, it is within the scope of the invention as presently perceived to include any suitable locking mechanism that can be locked to prevent movement of the locking mechanism, and that can be released to allow extension and retraction of the locking mechanism. Thus, the term "spring clutch" as used in this specification and in the claims includes any suitable mechanism that can be engaged to couple the movement of the back section 42 to a track-engaging roller 230 coupled to the clutch housing 214, and that can be disengaged to decouple the movement of the back section 42 from the track-engaging roller 230. In the embodiment shown in FIGS. 11–15, the spring clutch 210 is normally locked to couple the movement of the back section 42 to the track-engaging roller 230 to initially raise and then lower the thigh section 46 as the back section 42 is raised from a horizontal position to a near upright position through an intermediate position therebetween.

A longitudinally-extending bracket 220 (also referred to as the roller-supporting bracket) includes a pair of transversely-spaced vertical plates 226 defining an interior space for receiving the clutch housing 214 adjacent to the head end 32 of the bracket 220. The track-engaging roller 230 is rotatably mounted between the transversely-spaced vertical plates 226 of the bracket 220 adjacent to the foot end 34 of the bracket 220 by a transversely-extending pivot pin 234. The track-engaging roller 230 is supported on an upwardly-facing surface of a generally longitudinally-extending track 240 (also referred to as the longitudinally-extending support plate) attached to the stretcher frame 26 on the second side 38, and rides thereon. The longitudinally-extending track 240 includes a first downwardly-extending portion 242 (also referred to as the inclined or diverging portion) near the head end 32, and a second generally horizontally-extending portion 244 (also referred to as the straight portion) near the foot end 34 thereof.

The auto contour mechanism 200 includes a scissors-like arrangement 250 (also referred to as the center pivoting linkage) comprising a frame link 252 pivotally coupled to the stretcher frame 26 and a bracket link 254 pivotally coupled to the roller-supporting bracket 220. The frame link 252 includes a pair of transversely-spaced vertical plates 256 and a transversely-extending horizontal plate 258 extending between the transversely-spaced vertical plates 256 on the topside thereof. Likewise, the bracket link 254 includes a pair of transversely-spaced vertical plates 266 and a transversely-extending horizontal plate 268 extending between the transversely-spaced vertical plates 266 on the topside thereof. The head end 32 of the frame link 252 is coupled to the stretcher frame 26 for pivoting movement by a transversely-extending pivot pin 232, which is fixed. The foot end 34 of the bracket link 254 is coupled to the foot end 34 of the roller-supporting bracket 220 for pivoting movement by the transversely-extending pivot pin 234, which also supports the track-engaging roller 230. The foot end 34 of the frame link 252 and the head end 32 of the bracket link 254 are pivotally coupled to each other by a transversely-extending pivot pin 236 (also referred to as center pivot pin). A thigh section lifting roller 260 is rotatably supported by the center pivot pin 236 between the transversely-spaced vertical plates 256 of the frame link 252 and the transversely-spaced vertical plates 266 of the bracket link 254. The thigh section lifting roller 260 is configured to engage a downwardly-facing surface of a generally longitudinally-extending rail 270 attached to the underside of the thigh section 46 as shown in FIGS. 12–14.

Figure 2:
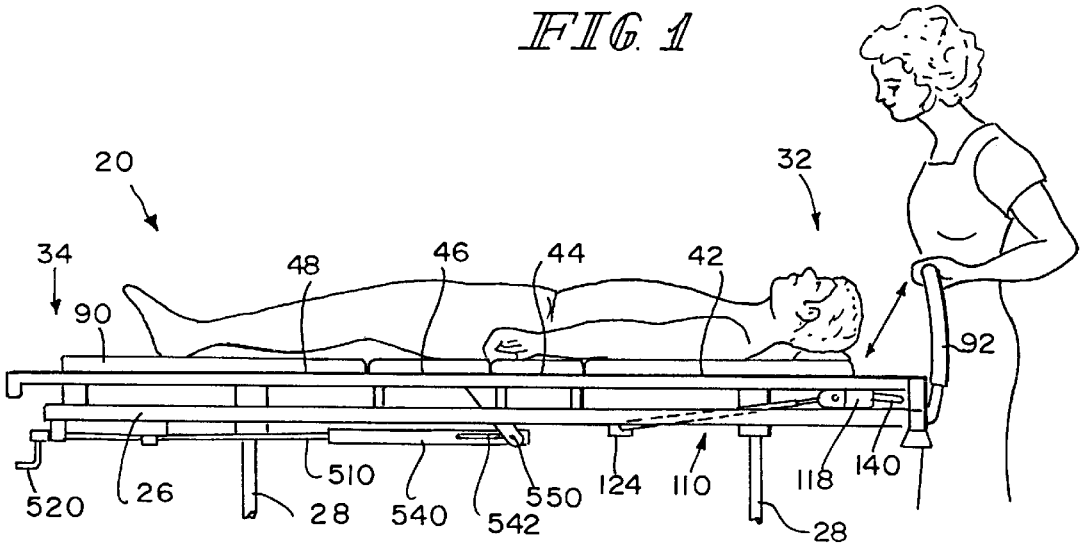
FIG. 2 is an elevation view of the illustrative stretcher of FIG. 1, with the back, seat, thigh and foot sections disposed horizontally, and showing a patient lying on his back on a mattress supported on the deck, and showing a caregiver standing near the head end of the stretcher between the push bars.
Figure 3:
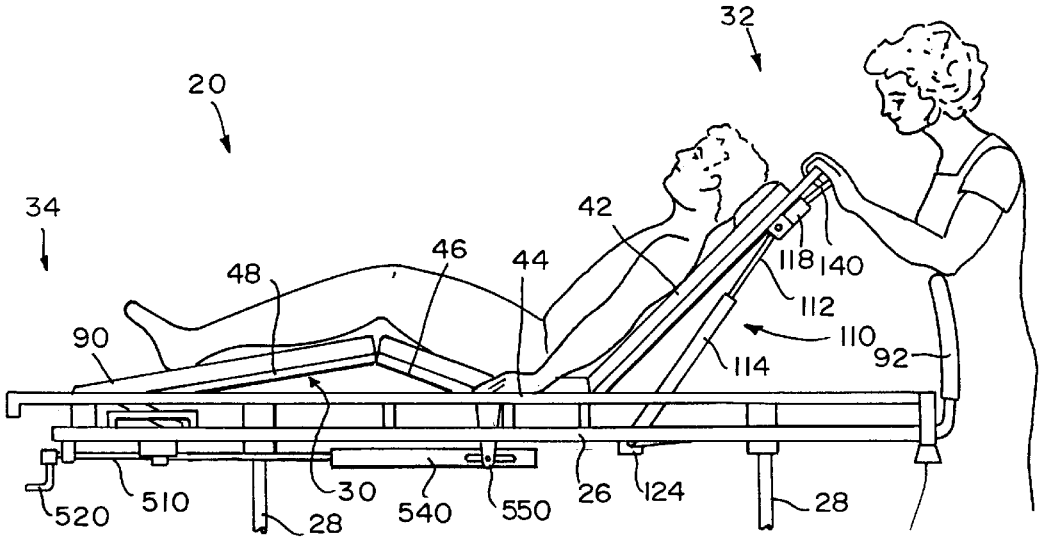
FIG. 3 is an elevation view similar to FIG. 2, with the caregiver lifting the back section to an intermediate raised position, which, in turn, lifts the thigh section to raise the knees of the patient.

In operation, when the back section 42 is raised from a generally horizontal position, the connecting rod 212 of the spring clutch 210 pulls the track-engaging roller 230 generally horizontally along the generally horizontally-extending portion 244 of the longitudinally-extending track 240 toward the head end 32 as shown in FIGS. 12 and 13. Movement of the track-engaging roller 230 toward the head end 32 closes the scissors-like arrangement 250 formed by the frame link 252 and the bracket link 254 pushing the thigh section lifting roller 260 upwardly. The thigh section lifting roller 260 then engages the longitudinally-extending rail 270 attached to the underside of the thigh section 46 to lift the thigh section 46 to, in turn, raise the knees of the patient supported on the deck 30 as shown in FIGS. 2 and 3. When the track-engaging roller 230 reaches the bend 246 in the longitudinally-extending track 240 and starts traveling downwardly along the downwardly-extending portion 242 of the longitudinally-extending track 240, the thigh section lifting roller 260 reverses direction of movement and starts moving downwardly as shown in FIGS. 13 and 14. This, in turn, lowers the thigh section 46 back to a generally horizontal position as the back section 42 is raised higher to an upright or nearly upright position as shown in FIGS. 3 and 4.

Thus, as the back section 42 is raised from a generally horizontal position, the auto contour mechanism 200 initially forces the thigh section 46 upwardly until the track-engaging roller 230 starts traveling downwardly along the downwardly-extending portion 242 of the longitudinally-extending track 240. When the track-engaging roller 230 starts traveling downwardly, the thigh section 46 is again lowered back to a generally horizontal position. On the other hand, when the back section 42 is lowered from an upright or near upright position to a generally horizontal position, the movement of the thigh section 46 is reversed. The thigh section 46 is initially raised from a generally horizontal position and then lowered back down to the generally horizontal position.

Figure 4:
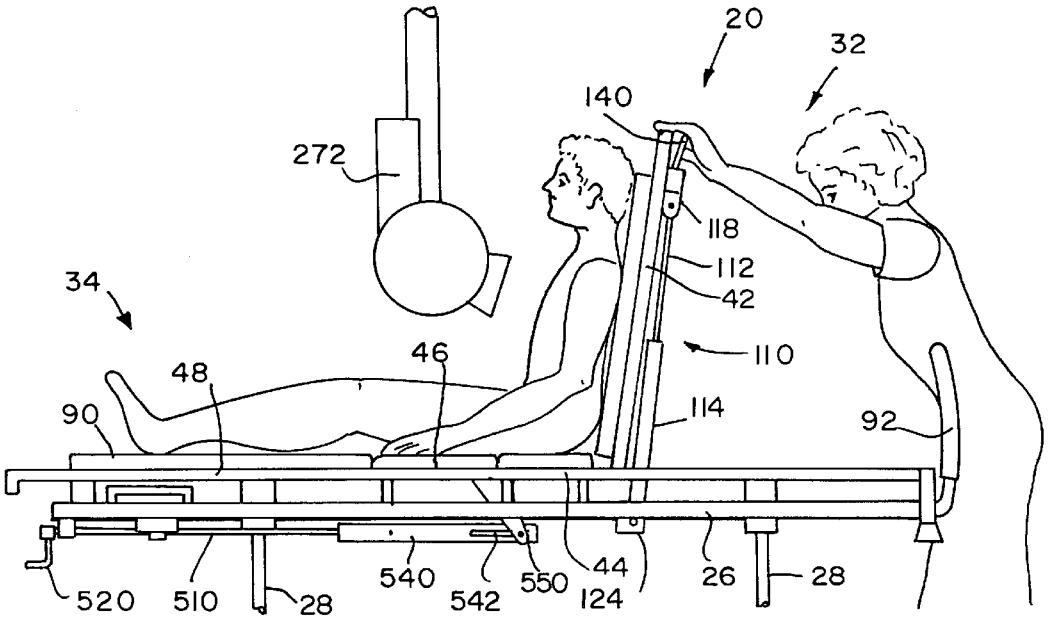
FIG. 4 is an elevation view similar to FIGS. 2 and 3, with the caregiver lifting the back section to a near upright position, which, in turn, lowers the thigh section back to a horizontal position, and showing chest x-ray equipment positioned near the patient sitting in an upright position.

The illustrative auto contour mechanism 200 not only prevents a patient from sliding toward the foot end 34 of the stretcher 20 when the back section 42 is raised as shown in FIG. 3, but it also allows the back section 42 to be raised to a near upright position for chest x-rays as shown in FIG. 4. The legs of the patient need to be in a horizontal position when the back section 42 is raised to a near upright position as shown in FIG. 4 so as not to constrict the patient's body where the angle between the patient's legs and the patient's back is less than 90 degrees. The chest x-ray equipment is identified in FIG. 4 by numeral 272.

Referring to FIGS. 15–22, the auto contour enabling/disabling mechanism 300 (also referred to as the first thigh section drive disabling mechanism) includes a rectangular housing 301 attached to an interior wall of a transversely-extending frame member 70 near the foot end 34 of the stretcher 20 adjacent to the second side 38. The housing 301 includes a pair of transversely-extending vertically-disposed end walls 302, 304 extending between a pair of longitudinally-extending vertically-disposed side walls 306, 308 and a horizontally-disposed top wall 309. A longitudinally-extending clutch release rod 310 (also referred to as the plunger rod) is mounted inside the housing 301 for translation in the longitudinal direction 40. The head end 32 of the clutch release rod 310 extends through an opening in a transversely-extending flange 312 secured to the underside of the top wall 309 of the housing 301. The foot end 34 of the clutch release rod 310 extends through openings in the end wall 304 and a transversely-extending flange 314 secured to the interior of the end wall 304. Bushings may be provided in the openings in the flanges 312, 314 for facilitating smooth translation of the clutch release rod 310.

The head end 32 of the clutch release rod 310 is coupled to the foot end 34 of a clutch release cable 320. The head end 32 of the clutch release cable 320 is coupled to the trigger plate 216 of the normally-engaged spring clutch 210 of the auto contour mechanism 200. When the clutch release cable 320 is pulled by the release rod 310 toward the foot end 34 in direction 322, the trigger plate 216 is moved to the clutch releasing position to unlock the spring clutch 210 so that the auto contour mechanism 200 is disabled and the back section 42 can be raised and lowered without also raising and lowering the thigh section 46. This is referred to as an auto-contour-disable mode (also referred to as auto-contour-off mode). When the clutch release cable 320 is instead released by the release rod 310, the trigger plate 216 returns to the clutch locking position to again lock the spring clutch 210 so that the thigh section 46 is initially raised and then lowered as the back section 42 is raised from a generally horizontal position to a near upright position through an intermediate position as shown in FIGS. 2–4. Also, the thigh section 46 is again raised and lowered as the back section 42 is lowered from a near upright position to a generally horizontal position. This is referred to as an auto-contour-enable mode (also referred to as auto-contour-on mode).

The auto contour enabling/disabling mechanism 300 further includes a flip-over handle 330 that is coupled to the foot end 34 of the clutch release rod 310 by a generally vertically-extending, off-center pivot pin 332. The flip-over handle 330 includes a slotted cam portion 334 and a handle portion 336. The slotted cam portion 334 is configured to include a generally horizontally-extending slot 338 for receiving the pivoted foot end 34 of the clutch release rod 310. The foot end 34 of the clutch release rod 210 is pivotally mounted in the horizontally-extending slot 338 by the vertically-extending, off-center pivot pin 332. The flip-over handle 330 is movable side-to-side between a first position where the handle portion 336 is disposed adjacent to the transversely-extending end wall 304 of the housing 301 on the first side 36 as shown in FIGS. 15, 16, 18 and 21, and a second position where the handle portion 336 is disposed adjacent to the transversely-extending end wall 304 of the housing 301 on the second side 38 as shown in FIGS. 20 and 22.

Figure 16:
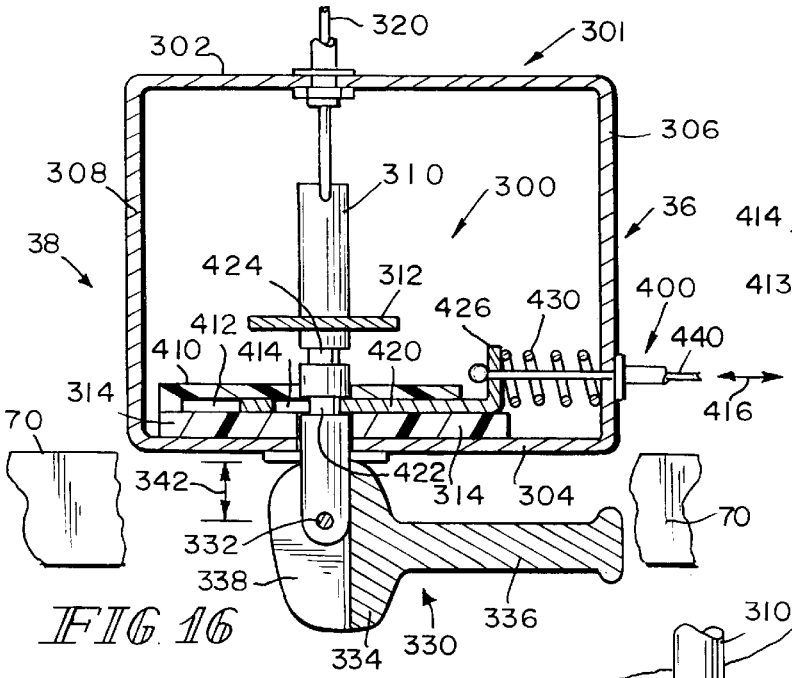
FIG. 16 is a plan view of the auto contour disabling mechanism, and showing the flip-over handle moved to a first position where the auto contour mechanism is enabled to initially raise and then lower the thigh section as the back section is raised from a horizontal position to a near upright position, and showing the latch plate inserted into a first groove in the clutch release rod to lock the flip-over handle in the first position.
Figure 18:
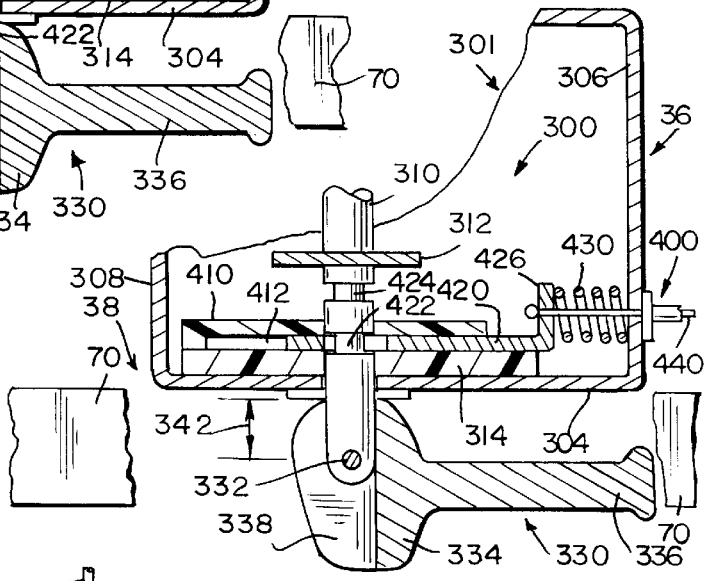
FIG. 18 is a plan view similar to FIG. 16, and showing the flip-over handle disposed in the first position, and the latch plate pulled out of the first groove in the clutch release rod to free the flip-over handle.
Figure 20:
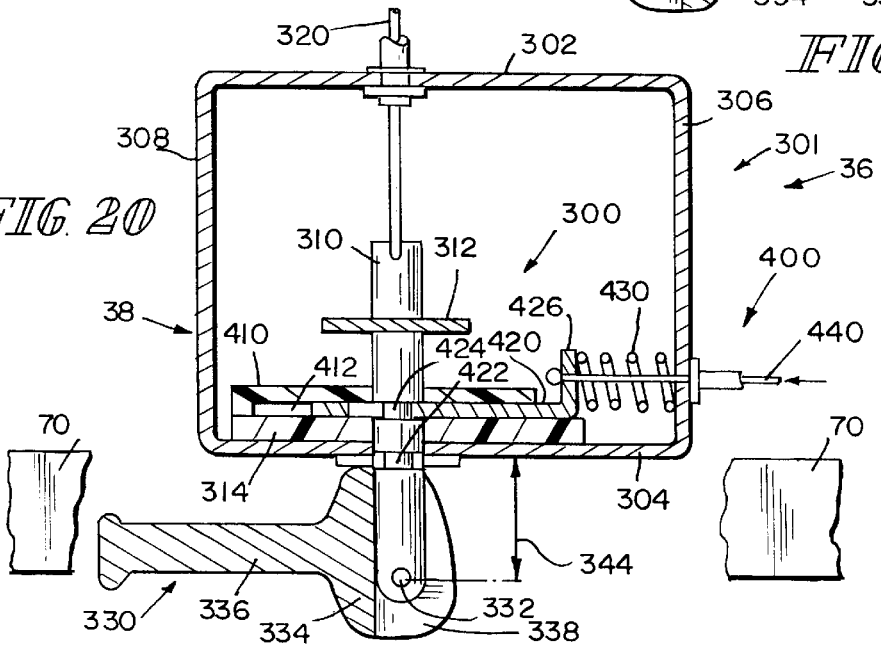
FIG. 20 is a plan view similar to FIGS. 16 and 18, and showing the flip-over handle moved to the second position where the auto contour mechanism is disabled to allow the back section to be raised and lowered without also raising and lowering the thigh section, and the latch plate inserted into the second groove in the clutch release rod to lock the flip-over handle in the second position.

The off-center pivot pin 332 is spaced from the transversely-extending end wall 304 of the housing 301 a first distance 342 when the flip-over handle 336 is in the first position as shown in FIGS. 16 and 18, and the off-center pivot pin 332 is spaced from the transversely-extending end wall 304 of the housing 301 a second distance 344 that is greater than the first distance 342 when the flip-over handle 330 is in the second position as shown in FIG. 20. Thus, the clutch release cable 320 is released and the auto contour mechanism 200 is enabled when the flip-over handle 330 is disposed on the first side 36 as shown in FIGS. 15, 16, 18 and 21. On the other hand, the clutch release cable 320 is pulled and the auto contour mechanism 200 is disabled when the flip-over handle 330 is disposed on the second side 38 as shown in FIGS. 20 and 22. Appropriate indicia may be attached to the flip-over handle 330 to indicate the auto contour on and off modes as shown in FIGS. 21 and 22. When the auto contour mechanism 200 is enabled, the thigh section 46 is initially raised and then lowered as the back section 42 is raised from a horizontal position to a near upright position through an intermediate position as shown in FIGS. 2-4. When the auto contour mechanism 200 is, however, disabled, the back section 42 can be raised and lowered without also raising and lowering the thigh section 46.

When the back section 42 is raised, the auto contour locking mechanism 400 is configured to lock the auto contour enabling/disabling mechanism 300 in either the auto-contour-enable mode (the flip-over handle 330 is on the first side 36) or the auto-contour-disable mode (the flip-over handle 330 is on the second side 38). Thus, when the back section 42 is raised, the auto contour locking mechanism 400 prevents movement of the flip-over handle 330 from the first position on the first side 36 to the second position on the second side 38 so that the spring clutch 210 cannot be inadvertently released and the knees of the patient supported on the stretcher 20 suddenly dropped. Also, when the back section 42 is raised, the auto contour locking mechanism 400 prevents movement of the flip-over handle 330 from the second position on the second side 38 to the first position on the first side 36 so that the spring clutch 210 cannot be inadvertently locked while the back section 42 is raised. Accidental locking of the spring clutch 210 while the back section 42 is raised can lock the back section 42 in a raised position, and prevent its lowering to the horizontal position.

Referring to FIGS. 15–22, the auto contour locking mechanism 400 (also referred to as the first thigh section drive locking mechanism) includes a transversely-extending plate member 410 secured to the interior of the flange 314 near the foot end 34 of the stretcher 20 adjacent to the second side 38. The plate member 410 is formed to include a transversely-extending passageway 412 for receiving a latch plate 420. The latch plate 420 is movable relative to the plate member 410 in a transverse direction 416. The latch plate 420 includes a keyhole opening 414 through which the foot end 34 of the clutch release rod 310 extends.

Figure 17:
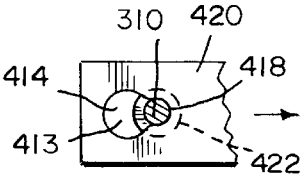
FIG. 17 is an end view corresponding to FIG. 16, and showing the latch plate inserted into the first groove in the clutch release rod to lock the flip-over handle in the first position.
Figure 19:
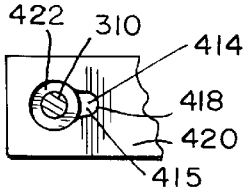
FIG. 19 is a partial end view corresponding to FIG. 18, and showing the latch plate pulled out of the first groove in the clutch release rod.

As shown in FIGS. 17 and 19, the keyhole opening 414 includes a large portion 413 and a small portion 415. The large portion 413 of the keyhole opening 414 is aligned with the clutch release rod 310 when the back section 42 is lowered to the horizontal position. This allows the clutch release rod 310 to slide freely between the clutch locking position shown in FIGS. 16 and 18 and the clutch releasing position shown in FIG. 20. When the back section 42 is raised, a biasing spring 430 pushes the latch plate 420 such that the small portion 415 of the keyhole opening 414 is aligned with one of two locking grooves 422, 424 in the clutch release rod 310 to lock the clutch release rod 310 in place. The biasing spring 430 extends between a right angle portion 426 of the latch plate 420 and the side wall 306 of the housing 301.

When the small portion 415 of the keyhole opening 414 is aligned with the clutch release rod 310, a curved locking edge 418 of the small portion 415 of the keyhole opening 414 is received in one of two locking grooves 422, 424 depending on the position of the clutch release rod 310. When the auto contour is on, the curved locking edge 418 is received in the locking groove 422 as shown in FIGS. 16 and 17. When the auto contour is off, the curved locking edge 418 is received in the locking groove 424 as shown in FIG. 20. When the curved locking edge 418 is received in one of the locking grooves 422, 424, the clutch release rod 310 is locked in place, preventing the operation of the flip-over handle 330. The spacing between the two locking grooves 422, 424 corresponds to the movement of the clutch release rod 310 in response to the side-to-side movement of the flip-over handle 330 between the first position on the first side 36 and the second position on the second side 38.

When the flip-over handle 330 is on the first side 36, the first locking groove 422 is aligned with the latch plate 420 as shown in FIGS. 16 and 17. When the back section 42 is raised while the flip-over handle 330 is on the first side 36, the biasing spring 430 pushes the curved locking edge 418 of the latch plate 420 into the first locking groove 422 to lock the clutch release rod 310 in the first position. In this state, the spring clutch 210 is engaged and the auto contour mechanism 200 is enabled to initially lift and then lower the thigh section 46 as the back section 42 is raised. When the flip-over handle 330 is on the second side 38, the second locking groove 424 is aligned with the latch plate 420 as shown in FIG. 20. When the back section 42 is raised while the flip-over handle 330 is on the second side 38, the biasing spring 430 pushes the curved locking edge 418 of the latch plate 420 into the second locking groove 424 to lock the clutch release rod 310 in the second position. In this state, the spring clutch 210 is unlocked and the auto contour mechanism 200 is disabled to allow the back section 42 to be raised and lowered without also raising and lowering the thigh section 46.

Referring to FIG. 15, a safety lock cable 440 has the foot end 34 coupled to the right angle portion 426 of the latch plate 420. The head end 32 of the safety lock cable 440 is coupled to a rocker arm 450 that is actuated by the back section 42. As the back section 42 is lowered to a horizontal or near horizontal position, the rocker arm 450 pulls the safety lock cable 440 to, in turn, pull the latch plate 420 so that the large portion of the keyhole opening 414 is aligned with the clutch release rod 310 to free the clutch release rod 310 to, in turn, free the flip-over handle 330. The flip-over handle 330 can then be moved from the first position on the first side 36 to the second position on the second side 38 to disable the auto contour mechanism 200 to allow the back section 42 to be raised and lowered without also raising and lowering the thigh section 46. Also, the flip-over handle 330 can then be moved from the second position on the second side 38 to the first position on the first side 36 to enable the auto contour mechanism 200 to allow the thigh section 46 to be initially raised and then lowered when the back section 42 is raised.

The rocker arm 450 is coupled to the frame 26 on the first side 36 adjacent to the foot end 34 of the back section 42 for pivoting movement about a vertically-extending pivot pin 452. A pair of transversely-spaced downwardly-extending flanges 454 are appended to the base strut 64 near the foot end 34 of the back section 42 adjacent to the first side 38. A wheel 456 is mounted in a slot formed by the transversely-spaced flanges 454 for rotation about a transversely-extending pivot pin 458. As the back section 42 is lowered from a raised position to a horizontal position, the wheel 456 engages the second side 38 of the rocker arm 450 to push the second side 38 of the rocker arm 450 toward the foot end 34 in a direction 460 and the first side 36 of the rocker arm 450 toward the head end 32 in an opposite direction 462. Thus, as the back section 42 is lowered to a horizontal position, the rocker arm 450 rotates in an anticlockwise direction 432 as viewed from the top. Anticlockwise motion of the rocker arm 450 pulls the safety lock cable 440 to, in turn, pull the latch plate 420 so that the large portion 413 of the keyhole opening 413 is aligned with the clutch release rod 310 to free the flip-over handle 330. The flip-over handle 330 can then be moved from the first position on the first side 36 to the second position on the second side 38 to disable the auto contour mechanism 200, or from the second position on the second side 38 to the first position on the first side 36 to enable the auto contour mechanism 200.

As the back section 42 is raised, the transversely-spaced flanges 454 swing away from the rocker arm 450. The biasing spring 430 then pushes the latch plate 420 so that the small portion 415 of the keyhole opening 414 is aligned with the clutch release rod 310 and the curved locking edge 418 of the latch plate 420 is pushed into the first locking groove 422 if the flip-over handle 330 is in the first position on the first side 36 or the second locking groove 424 if the flip-over handle 330 is in the second position on the second side 38.

In summary, when the back section 42 is lowered to a horizontal or near horizontal position, the wheel 456 rotatably mounted to the transversely-spaced flanges 454 appended to the base strut 64 actuates the rocker arm 450 to pull the safety lock cable 440 to, in turn, pull the latch plate 420 so that the large portion 413 of the keyhole opening 414 is aligned with the clutch release rod 310, freeing the clutch release rod 310. The flip-over handle 330 can then be moved from the first position on the first side 36 to the second position on the second side 38, or from the second position on the second side 38 to the first position on the first side 36. On the other hand, when the back section 42 is raised, the wheel 456 rotatably mounted to the transversely-spaced flanges 454 appended to the base strut 64 disengages from the rocker arm 450 to allow the biasing spring 430 to push the curved locking edge 418 of the latch plate 420 into the one of the locking grooves 422, 424 to lock the clutch release rod 310 to, in turn, lock the flip-over handle 330 so that it cannot be moved.

The knee crank mechanism 500 (also referred to herein as the second thigh section drive) operates to lift the thigh section 46 independently of the auto contour mechanism 200. This feature (a) allows the caregiver to lift the thigh section 46 while the back section 42 is in a horizontal or near horizontal position, and (b) allows the caregiver to lift the thigh section 46 above the level permitted by the auto contour mechanism 200. This means that if the thigh section 46 is raised to a 30 degree angle by the auto contour mechanism 200, the knee crank mechanism 500 can be operated to raise the thigh section 46 even higher, for example, up to a 45 degree angle.

Referring to FIGS. 23 and 24, the knee crank mechanism 500 includes a longitudinally-extending ball screw 510 rotatably mounted to the stretcher frame 26 on the first side 36. The foot end 34 of the ball screw 510 is supported in a bearing assembly 512 coupled to the transversely-extending frame member 70. A crank 520 is coupled to the foot end 34 of the ball screw 510 to turn the ball screw 510. As shown, the crank 520 is pivotally mounted to the ball screw 510, so that it can be moved to an out-of-the-way position under the stretcher frame 26. The head end 32 of the ball screw 510 is threaded, and received in a nut 530 crimped in place near the foot end 34 of a longitudinally-extending tube 540. As the crank 520 is turned, the ball screw 510 threads into or out of the nut 530 fixed to the tube 540 to lengthen or shorten the distance between the head end 32 of the tube 540 and the transversely-extending frame member 70 at the foot end 34. The head end 32 of the tube 540 is formed to include a transversely-extending elongated slot 542 for receiving a transversely-extending pivot pin 552 mounted on a downwardly-extending lever arm 550 appended to the underside of the thigh section 46 near the head end 32 thereof. The transversely-extending elongated slot 542 allows the auto contour mechanism 200 to raise the thigh section 46 without also having to turn the crank 520. The elongated slot 542 is sufficiently long to allow the auto contour mechanism 200 to raise the thigh section 46 to about a 30 degree angle independently of the knee crank mechanism 500.

In operation, when the crank 520 is turned, the ball screw 510 threads into the nut 530 crimped to the tube 540 to translate the tube 540 toward the foot end 34. When the pivot pin 552 fixed to the lever arm 550 engages the curved leading edge 544 of the elongated slot 542, the pivot pin 552 is pulled toward the foot end 34. Motion of the pivot pin 552 toward the foot end 34 pulls the lever arm 550 therewith 30 to elevate the thigh section 46 as shown in FIG. 24. The knee crank mechanism 500 can elevate the thigh section 46 up to a 45 degree angle. If the thigh section 46 is already raised by the auto contour mechanism 200, the knee rank mechanism 500 can raise the thigh section 46 even higher. For example, if the thigh section 46 is raised to a 30 degree angle by the auto contour mechanism 200, the knee crank mechanism 500 can raise the thigh section 46 to a 45 degree angle. The crank 520 must be initially turned until the curved leading edge 544 of the elongated slot 542 engages the pivot pin 552 before the thigh section 46 will rise higher than its current position. To lower the thigh section 46, the crank 520 is turned in the opposite direction so that the ball screw 510 threads out of the nut 530 to move the tube 540 toward the head end 32.

Referring to FIGS. 25–30, another embodiment of the illustrative stretcher 20 is shown. The overall concept of the two embodiments is generally the same. In the embodiment of FIGS. 25–30, the back section drive 100, the auto contour mechanism 200 and the knee crank mechanism 500 are generally the same as the corresponding mechanisms shown in FIGS. 8–10, 11–15 and 23–24 respectively. However, there are differences between the auto contour enabling/disabling and locking mechanisms 1300, 1400 shown in FIGS. 25–30 and the corresponding enabling/disabling and locking mechanisms 300, 400 in FIGS. 15–22. For example, one major difference between the two embodiments is that the hand activated controls for the auto contour mechanism 200 are located near the head end 32 adjacent to the back section release bar 140, instead of near the foot end 34. The elements of the auto contour enabling/disabling and locking mechanisms 1300, 1400 shown in FIGS. 25–30 bear the same reference numerals as the like elements in FIGS. 15–22, except they are preceded by a numeral "1". Thus, the auto contour enabling/disabling mechanism 1300 includes a housing 1301 and a clutch release rod 1310. The auto contour locking mechanism 1400, on the other hand, includes a latch plate 1420 having a keyhole opening 1414, a pair of locking grooves 1422 and 1424 formed in the clutch release rod 1310 and a biasing spring 1430.

Figure 25:
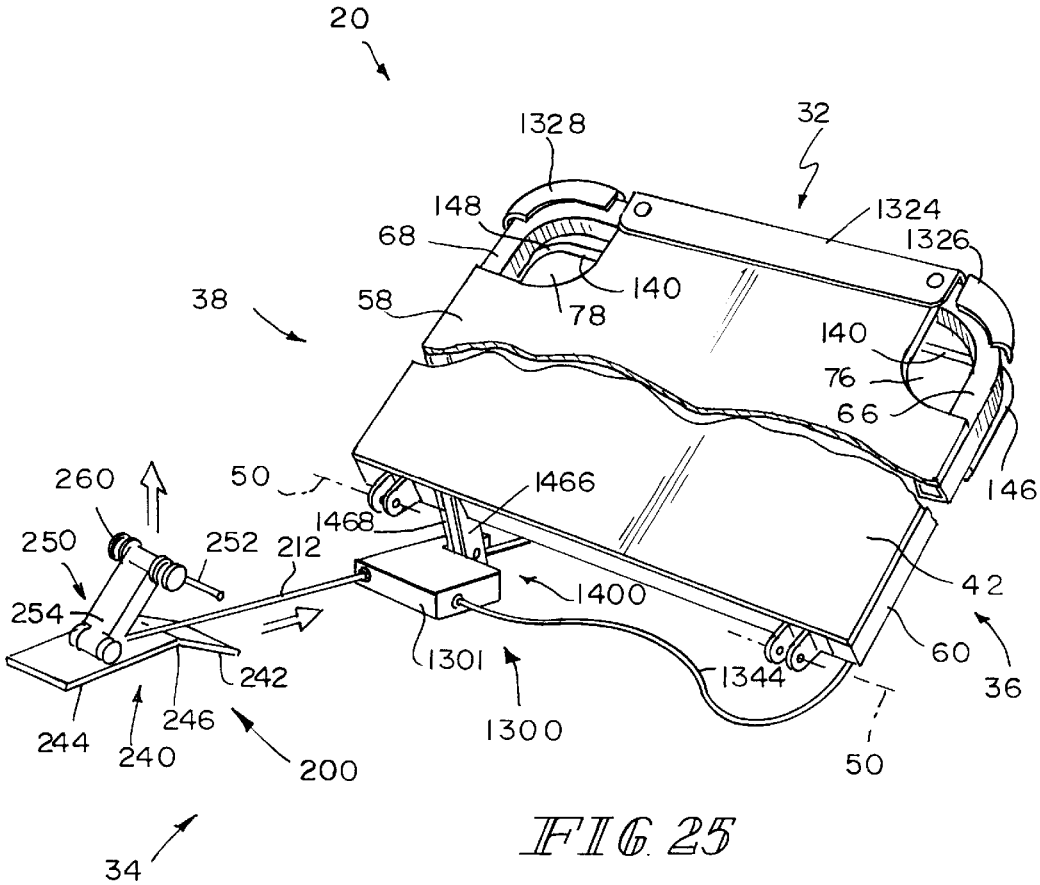
FIG. 25 is a partial perspective view of another embodiment of the illustrative stretcher having an auto contour mechanism, and showing a pair of auto contour handles coupled to the back section near the head end, and a cable coupling the handles to a clutch release rod, the clutch release rod being slidably mounted inside a housing for translation in a lateral direction, the housing being pivotally mounted to a pair of downwardly-extending flanges appended to the back section.

As shown in FIG. 25, the auto contour enabling/disabling mechanism 1300 includes a transversely-extending elongated bracket member 1324 coupled to the tubular frame member 60 of the back section 42 near the head end 32 of the stretcher 20. A pair of handles 1326, 1328 are appended to the bracket member 1328 on opposite sides 36, 38 adjacent to the respective corner portions 66, 68 of the frame member 60. The handles 1326, 1328 are movable between a clutch releasing position where the handles 1326, 1328 are spaced apart from the respective corner portions 66, 68 and a clutch locking position where the handles 1326, 1328 are spaced closer to the respective corner portions 66, 68. The handles 1326, 1328 are normally biased in the clutch releasing position where the auto contour is off. When the auto contour is off, the auto contour mechanism 200 is decoupled from the back section 42 so that the back section 42 can be raised and lowered without also raising and lowering the thigh section 46. When the handles 1326, 1328 are squeezed so that they are moved to the clutch locking position closer to the respective corner portions 66, 68, the auto contour is turned on. When the auto contour is on, the auto contour mechanism 200 is coupled to the back section 42 so that the thigh section 46 is raised and lowered as the back section 42 is raised. The overlapping design of the handles 1326, 1328 allows operation of any one of the two handles 1326, 1328 to activate the auto contour. It will be noted that the handles 1326, 1328 are located adjacent to the respective corner portions 146, 148 of the release bar 140 near the head end 32. This permits the caregiver to grasp one of the corner portions 146, 148 of the release bar 140 and one of the handles 1326, 1328 with one hand to simultaneously activate both the back section drive 100 and the auto contour mechanism 200.

Figure 26:
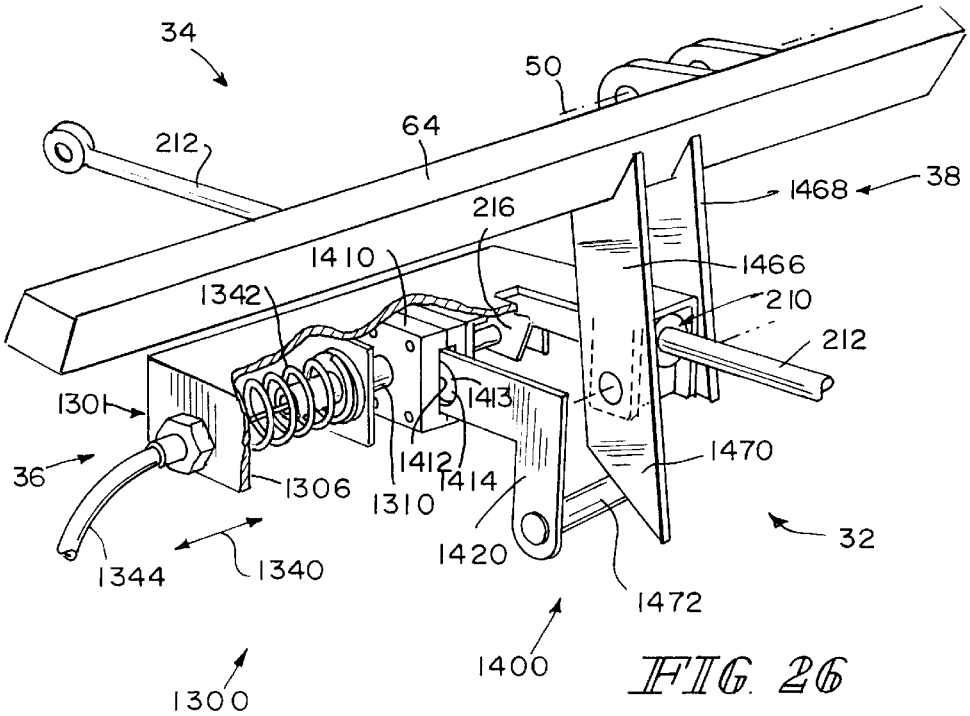
FIG. 26 is a partial perspective view showing the auto contour enabling/disabling and locking mechanisms.
Figure 27:
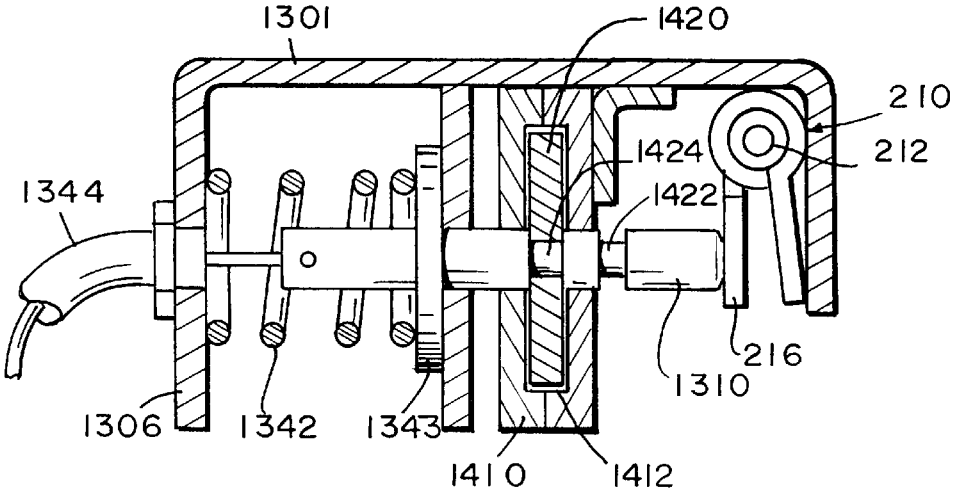
FIGS. 27 and 28 are sectional views showing the clutch release rod in a clutch releasing position and a clutch locking position respectively.
Figure 28:
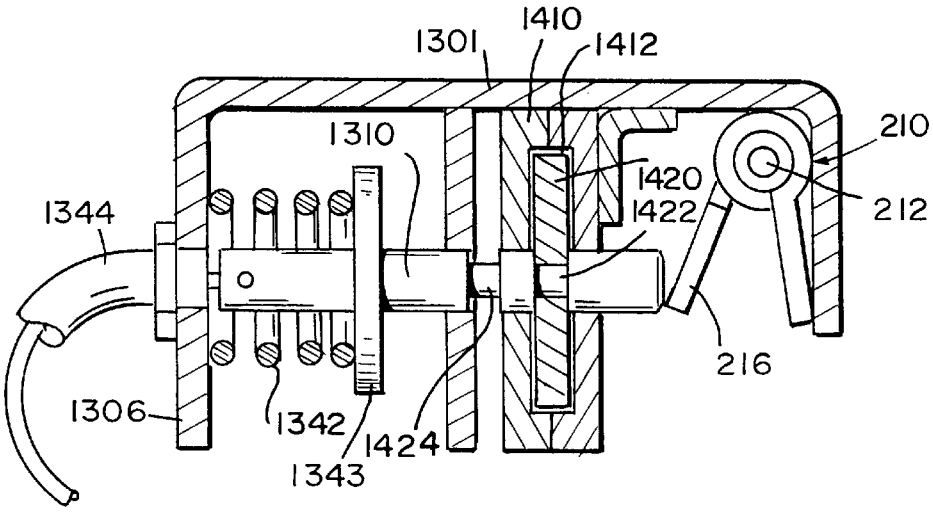

Referring to FIGS. 26–28, the auto contour enabling/disabling mechanism 1300 includes a clutch release rod 1310 slidably mounted inside the housing 1301 for translation in a lateral direction 1340. A spring 1342 normally biases the clutch release rod 1310 against the trigger plate 216 of the spring clutch 210 to move the trigger plate 216 to the clutch releasing position as shown in FIG. 27, where the spring clutch 210 is disengaged and the auto contour is off. The biasing spring 1342 extends between a retaining washer 1343 appended to the clutch release rod 1310 and a side wall 1306 of the housing 1301. When the handles 1326, 1328 are squeezed, a cable 1344 pulls the clutch release rod 1310 toward the wall 1306 of the housing 1301 against the force of the biasing spring 1342 to turn on the auto contour as shown in FIG. 28. When the clutch release rod 1310 moves toward the wall 1306, the coil gripping springs (not shown) inside the clutch 210 automatically move the trigger plate 216 to the clutch locking position and constrict around the connecting rod 212. The cable 1344 is routed through the tubular frame member 60 of the back section 42 to the clutch release rod 1310. The cable 1344 includes a wire portion 1366 and a sheath portion 1368. A head end 32 of the wire portion 1366 is coupled to the handles 1326, 1328, and a foot end 34 of the wire portion 1366 is coupled to the clutch release rod 1310.

Figure 29:
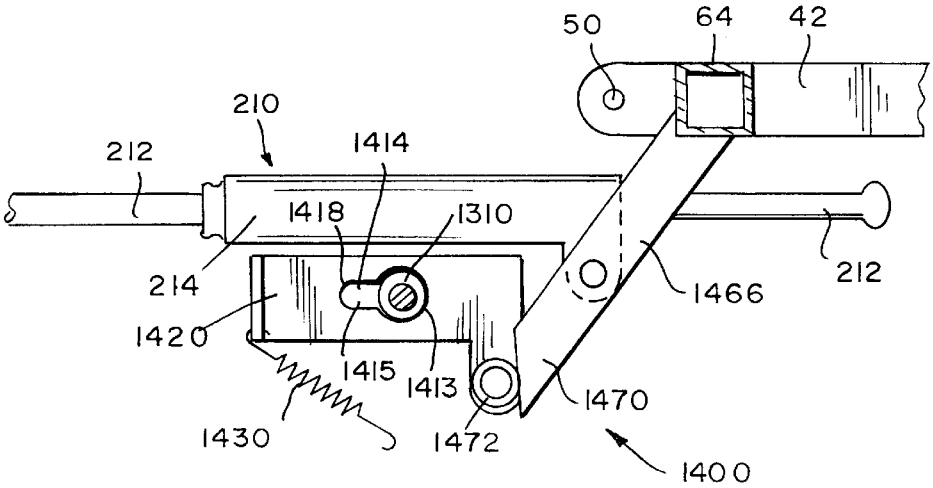
FIG. 29 is a partially-broken-away end view showing the back section lowered to a horizontal position, and showing a downwardly-extending flange coupled to the back section engaging a latch plate and moving it to a position where the large portion of a keyhole opening in the latch plate is aligned with the clutch release rod.

The auto contour locking mechanism 1400 includes a longitudinally-extending plate member 1410 secured to the top wall of the housing 1301 as shown in FIGS. 26–28. The plate member 1410 is formed to include a longitudinally-extending passageway 1412 for receiving a latch plate 1420. The latch plate 1420 is movable relative to the plate member 1410 in a longitudinal direction 40. The latch plate 1420 prevents the operation of the auto contour enabling/disabling mechanism 1300 when the back section 42 is raised. The latch plate 1420 includes a keyhole opening 1414 through which the clutch release rod 1310 extends as shown in FIG. 29. The keyhole opening 1414 includes a large portion 1413 and a small portion 1415. The large portion 1413 of the keyhole opening 1414 is aligned with the clutch release rod 1310 when the back section 42 is lowered to the horizontal position. This allows the clutch release rod 1310 to slide freely between the clutch releasing position shown in FIG. 27 and the clutch locking position shown in FIG. 28. Thus, when back section 42 is lowered to the horizontal position and the large portion 1413 of the keyhole opening 1414 is aligned with the clutch release rod 1310, the handles 1326, 1328 of the auto contour enabling/disabling mechanism 1300 can be squeezed to turn on the auto contour mechanism 200.

When the back section 42 is raised or pivoted upwardly from the horizontal position, the small portion 1415 of the keyhole opening 1414 is aligned with the clutch release rod 1310. When the small portion 1415 of the keyhole opening 1414 is aligned with the clutch release rod 1310, a curved locking edge 1418 of the small portion 1415 of the keyhole opening 1414 is received in one of two locking grooves 1422, 1424 depending on the position of the clutch release rod 1310. When the handles 1326, 1328 are squeezed and the auto contour is turned on, the curved locking edge 1418 is received in the locking groove 1422 as shown in FIG. 28. When the auto contour is off, the curved locking edge 1418 is received in the locking groove 1424 as shown in FIG. 27. When the curved locking edge 1418 is received in one of the locking grooves 1422, 1424, the clutch release rod 1310 is locked in place, preventing the operation of the handles 1326, 1328. As previously indicated, the handles 1326, 1328 can be squeezed only when the back section 42 is lowered to the horizontal position and the large portion 1413 of the keyhole opening 1414 is aligned with the clutch release rod 1310.

A pair of transversely-spaced downwardly-extending flanges 1466, 1468 are appended to the base strut 64 of the back section 42 adjacent to the second side 38 as shown in FIG. 26. Both the housing 1301 and the spring clutch 210 are pivotally mounted to the downwardly-extending flanges 1466, 1468 appended to the back section 42. When the back section 42 is lowered as shown in FIG. 29, an extension 1470 of the inner flange 1466 engages a transversely-extending sleeved rod 1472 attached to the latch plate 1420 and moves the latch plate 1420 against the force of the biasing spring 1430. The biasing spring 1430 has a first end attached to the latch plate 1420 and a second end attached to the housing 1301 at a point not shown. This aligns the large portion 1413 of the keyhole opening 1414 with the clutch release rod 1310, freeing the clutch release rod 1310 to slide in the keyhole opening 1414. The extension 1470 of the inner flange 1466 has an angle cut on it so that it acts as a cam when it engages the sleeved rod 1472. When the back section 42 is raised, the extension 1470 of the inner flange 1466 swings away from the sleeved rod 1472. This allows the biasing spring 1430 to pull the latch plate 1420 so that the small portion 1415 of the keyhole opening 1414 is aligned with the clutch release rod 1310, locking the clutch release rod 1310 in place.

If the handles 1326, 1328 of the auto contour enabling/disabling mechanism 1300 are squeezed while the back section 42 is lowered, the cable 1344 pulls the clutch release rod 1310 so that the locking groove 1422 is aligned with the latch plate 1420 as shown in FIG. 28. When the back section 42 is raised thereafter, the biasing spring 1430 pulls the latch plate 1420 so that the curved locking edge 1418 of the latch plate 1420 is received in the locking groove 1422, locking the auto contour in the on mode. The auto contour remains on until the back section 42 is again lowered to the horizontal position. On the other hand, when the back section 42 is raised without squeezing the handles 1326, 1328, the curved locking edge 1418 of the latch plate 1420 is received in the locking groove 1424, locking the auto contour in the off mode. The auto contour remains off until one of the handles 1326, 1328 is squeezed while the back section 42 is again lowered to the horizontal position.

Figure 30:
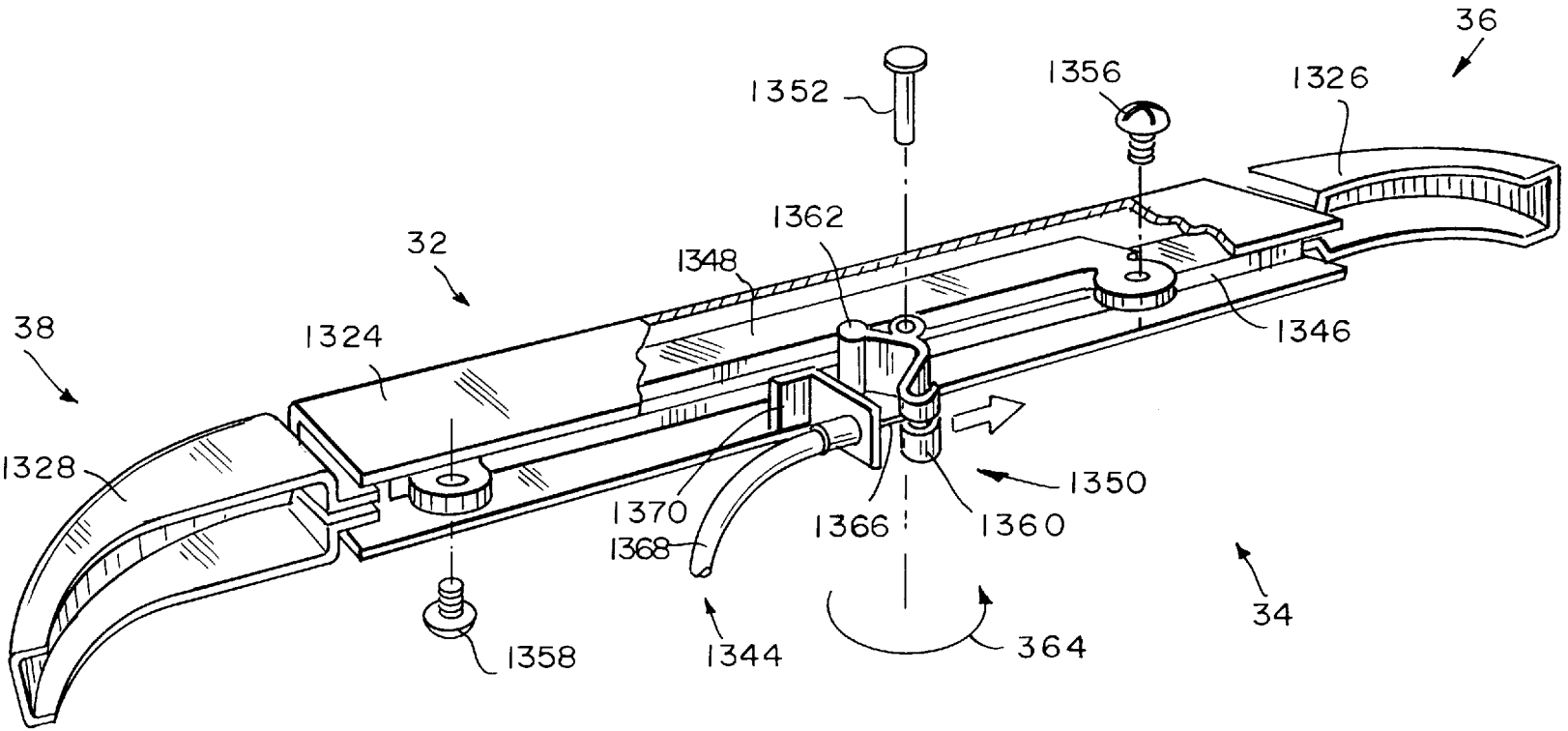
FIG. 30 is a perspective view showing the construction and operation of the auto contour handles.

The operation of the auto contour handles 1326, 1328 will be explained with reference to FIG. 30. As previously indicated, the handles 1326, 1328 are located on opposite sides 36, 38 near the head end 32 of the back section 42. The first handle 1326 is attached to a first link 1346 on the first side 36. The second handle 1328 is attached to a second link 1348 on the second side 38. A rocker arm 1350 is pivotally mounted to the bracket member 1324 for rotation about a pivot pin 1352. The first and second links 1346, 1348 are pivotally coupled to the bracket member 1324 on opposite sides of the rocker arm 1350. Thus, the first link 1346 is pivotally coupled to the bracket member 1324 for rotation about a pivot pin 1358. The second link 1348 is pivotally coupled to the bracket member 1324 for rotation about a pivot pin 1356. The rocker arm 1350 includes a hook portion 1360 and an actuator portion 1362. The hook portion 1360 of the rocker arm 1350 is coupled to the wire portion 1366 of the cable 1344. When either one or both handles 1326, 1328 are squeezed while the back section 42 is horizontal, the actuator portion 1362 of the rocker arm 1350 engages one or both links 1346, 1348 to rotate the rocker arm 1350 in an anticlockwise direction 1364. This causes the hook portion 1360 to pull the wire portion 1366 of the cable 1344 to, in turn, pull the clutch release rod 1310 to activate the auto contour mechanism 200. The outer sheath portion 1368 of the cable 1344 is attached to a retainer 1370 appended to the bracket member 1324. As previously indicated, the cable 1344 is routed through the tubular frame member 60 of the back section 42 to the clutch release rod 1310. The handles 1326, 1328 and the rocker arm 1350 are normally biased in the clutch releasing position where the auto contour is off.

Although the invention has been described in detail with reference to a certain illustrated embodiment, variations and modifications exist within the scope and spirit of the invention as described and as defined in the following claims.

What is claimed is:

1. A patient support apparatus comprising:

a frame, a deck coupled to the frame, the deck including a back section, a seat section and a thigh section, the back, seat and thigh sections being longitudinally spaced apart and transversely extending with at least the back and thigh sections being articulated relative to the frame, a back section drive, a first thigh section drive, and a second thigh section drive, the back section drive being coupled to the back section to move the back section between a lowered and a raised position through an intermediate position therebetween, the first thigh section drive being coupled to the back section such that the thigh section moves from a lowered position to a raised position as the back section moves from the lowered position to the intermediate position and such that the thigh section moves from the raised position to the lowered position as the back section moves from the intermediate position to the raised position, the first thigh section drive comprising a track coupled to the frame, and a track-engaging member movable along the track and coupled to the thigh section and coupled t the back section, and the second thigh section drive being coupled to the thigh section and being operable independent of the back section drive to raise and lower the thigh section.

2. The apparatus of claim 1, wherein the track includes a first straight portion along which the track-engaging member moves to raise the thigh section and a second inclined portion along which the track-engaging member moves to lower the thigh section as the back section is raised.

3. The apparatus of claim 1, wherein the track-engaging member movable along the track is a roller.

4. The apparatus of claim 3, wherein the track-engaging roller is coupled to the back section to be moved along the track initially along the straight portion to raise the thigh section and then along the inclined portion to lower the thigh section as the back section is raised.

5. The apparatus of claim 4, wherein the first thigh section drive includes a center pivoting linkage having a first end coupled to the frame for pivoting movement about a fixed pivot pin, a second end coupled to the track-engaging roller for pivoting movement about a movable pivot pin, and a middle end rotatably coupled to a lifting roller configured to be coupled to the thigh section so that the thigh section is initially raised and then lowered as the back section is raised.

6. The apparatus of claim 4, wherein the first thigh section drive includes first and second links, wherein the first link has a first end coupled to the frame for pivoting movement about a fixed pivot pin and a second end coupled to a first end of the second link for pivoting movement about a center pivot pin, wherein the second link has a second end coupled to the track-engaging roller for pivoting movement about a movable pivot pin, and wherein the first thigh section drive includes a lifting roller coupled to the center pivot pin and configured to be coupled to the thigh section so that the thigh section is initially raised and then lowered as the back section is raised.

7. A patient support apparatus comprising:

a frame, a deck coupled to the frame, the deck including a back section, a seat section and a thigh section, the back, seat and thigh sections being longitudinally spaced apart and transversely extending with at least the back and thigh sections being articulated relative to the frame, a back section drive, a first thigh section drive, and a second thigh section drive, the back section drive being coupled to the back section to move the back section between a lowered position and a raised position through an intermediate position therebetween, the first thigh section drive being coupled to the back section such that the thigh section moves from a lowered position to a raised position as the back section moves from the lowered position to the intermediate position and such that the thigh section moves from the raised position to the lowered position as the back section moves from the intermediate position to the raise position, the first thigh section drive including a linkage configured to be coupled to the thigh section and a spring cutch coupling back section to the linkage, the spring clutch including a housing, a coil gripping spring received inside the housing and a connecting rod, the spring clutch being lockable so that the gripping spring constricts around the connecting rod preventing the connecting rod from sliding relative to the gripping spring and the clutch housing to couple the back section to the linkage so that the thigh section is initially raised and then lowered as the back section is raised, the spring clutch being releasable so that the gripping spring loosens its grip on the connecting rod allowing the connecting rod to slide relative to the gripping spring and the clutch housing to decouple the back section from he linkage so that the back section can be raised without also raising the thigh section, and the second thigh/section drive being coupled to the thigh section and being operable independent of the back section drive to raise and lower the thigh section.

8. The apparatus of claim 7, including a handle coupled to the spring clutch, and movable to a first position where the spring clutch is locked to couple the back section to the linkage and to a second position where the spring clutch is released to decouple the back section from the linkage.

9. The apparatus of claim 8, wherein the handle is located near a foot end of the apparatus.

10. The apparatus of claim 9, including a release rod coupled to the handle and a cable coupling the release rod to the spring clutch.

11. The apparatus of claim 10, including a latch plate coupled to the back section and coupled to the release rod for locking the release rod when the back section is raised and freeing the release rod when the back section is not raised.

12. The apparatus of claim 8, wherein the handle is located near a head end of the apparatus.

13. A patient support apparatus comprising:

a frame, a deck coupled to the frame, the deck including a back section, a seat section and a thigh section, the back, seat and thigh sections being longitudinally spaced apart and transversely extending with at least the back and thigh sections being articulated relative to the frame, a back section drive coupled to the back section to raise and lower the back section, a first thigh section drive coupled to the back section and the thigh section to initially raise and then lower the thigh section as the back section is raised, the first thigh section drive comprising a track coupled to the frame, and a track-engaging member movable along the track and coupled to the thigh section and coupled to the back section, and a second thigh section drive coupled to the thigh section and operable independent of the back section drive to raise and lower the thigh section.

14. The apparatus of claim 13, wherein the track includes a first straight portion along which the track-engaging member moves to raise the thigh section and a second inclined portion along which the track-engaging member moves to lower the thigh section as the back section is raised.

15. The apparatus of claim 14, wherein the track-engaging member movable along the track is a roller.

16. The apparatus of claim 15, including linkage coupling the track-engaging roller to the back section to move the track-engaging roller along the track initially along the straight portion to raise the thigh section and then along the inclined portion to lower the thigh section as the back section is raised.

17. The apparatus of claim 16, wherein the linkage comprises a spring clutch including a housing, a coil gripping spring received inside the housing and a connecting rod, the connecting rod having a first end coupled to the back section for pivoting movement about a pivot pin, the connecting rod having a second end slidably received inside the gripping spring, wherein the spring clutch is lockable so that the gripping spring constricts around the connecting rod preventing the connecting rod from sliding relative to the gripping spring and the clutch housing to couple the back section to the track-engaging roller so that the thigh section is initially raised and then lowered as the back section is raised, the spring clutch is releasable so that the gripping spring loosens its grip on the connecting rod allowing the connecting rod to slide relative to the gripping spring and the clutch housing to decouple the back section from track-engaging roller so that the back section can be raised without also raising the thigh section.

18. The apparatus of claim 17, including a handle coupled to the spring clutch, and movable to a first position where the spring clutch is locked to couple the back section to the track-engaging roller and to a second position where the spring clutch is released to decouple the back section from the track-engaging roller.

19. The apparatus of claim 18, wherein the handle is located near a foot end of the apparatus.

20. The apparatus of claim 19, including a release rod coupled to the handle and a cable coupling the release rod to the spring clutch.

21. The apparatus of claim 20, including a latch plate coupled to the back section and coupled to the release rod for locking the release rod when the back section is raised and freeing the release rod when the back section is not raised.

22. The apparatus of claim 21, including a bracket having a first end coupled to the clutch housing and a second end rotatably coupled to the track-engaging roller.

23. A patient support apparatus comprising:

a frame, a deck coupled to the frame, the deck including a back section, a seat section and a thigh section, the back, seat and thigh sections being longitudinally spaced apart and transversely extending with at least the back and thigh sections being articulated relative to the frame, a back section drive, a thigh section drive, and the back section drive being coupled to the back section to raise and lower the back section, the back section drive and the thigh section drive being operatively coupled together such that the thigh section is raised and lowered as the back section is raised and lowered, and the back section drive including a control coupled to the back section near the head end thereof that can be actuated to adjust the position of the back section.

24. The apparatus of claim 23, wherein the control comprises a manually-actuated release bar movably coupled to the underside of the back section.

25. The apparatus of claim 24, wherein the release bar is movable between a first locking position spaced apart from the underside of the back section where the back section is prevented from moving relative to the frame, and a second releasing position spaced closer to the underside of the back section where the back section is allowed to move relative to the frame.

26. The apparatus of claim 23, wherein the back section provides the operative connection between the back section drive and thigh section drive.

27. The apparatus of claim 26, wherein the movement of the back section moves the thigh section drive.

28. The apparatus of claim 26, wherein the back section is coupled to the thigh section drive such that movement of the back section causes the thigh section drive to move the thigh section.

29. A patient support apparatus comprising:

a frame, a deck coupled to he frame, the deck including a back section, a seat section and a thigh section, the back, seat and thigh sections being longitudinally spaced apart and transversely extending with at least the back and thigh sections being articulated relative to the frame, a back section drive coupled to the back section to raise and lower the back section, a thigh section drive configured to be coupled to the back section and the thigh section to initially raise and the lower the thigh section as the back section is raised, a thigh section drive enabling/disabling mechanism having a first state where the thigh section drive is decoupled from the back section and having a second state where the thigh section drive is couple to the back section, and a thigh section drive locking mechanism configured to prevent the operation of the thigh section drive enabling/disabling mechanism in response to raising of the back section.

30. The apparatus of claim 29, wherein the thigh section drive enabling/disabling mechanism includes a handle, and wherein the handle is movable between a first releasing position where the thigh section drive is decoupled from the back section and a second locking position where the thigh section drive is coupled to the back section.

31. The apparatus of claim 30, wherein the back section includes a frame member, wherein the handle is coupled to the frame member near the head end of the patient support apparatus, wherein the handle is normally biased in the first releasing position spaced apart from the frame member, and wherein the handle is movable to the second locking position spaced closer to the frame member.

32. The apparatus of claim 31, wherein the frame member includes a pair of corner portions near the head end, wherein thigh section drive enabling/disabling mechanism includes a pair of handles coupled to the frame member adjacent to the respective corner portions, wherein the handles are normally biased in the first releasing position spaced apart from the respective corner portions, and wherein the handles are movable to the second locking position spaced closer to the respective corner portions.

33. The apparatus of claim 30, wherein the thigh section drive includes a linkage coupled to the thigh section and a spring clutch coupling the linkage to the back section.

34. The apparatus of claim 33, wherein the spring clutch includes a housing, a coil gripping spring received inside the housing and a connecting rod, wherein the spring clutch is releasable so that the gripping spring loosens its grip on the connecting rod allowing the connecting rod to slide relative to the clutch housing and the gripping spring to decouple the back section from the linkage so that the back section can be raised and lowered without also raising and lowering the thigh section, and wherein the spring clutch is lockable so that the gripping spring constricts around the connecting rod preventing the connecting rod from sliding relative to the clutch housing and the gripping spring to couple the back section to the linkage so that the thigh section is initially raised and then lowered as the back section is raised.

35. The apparatus of claim 34, wherein the spring clutch includes a trigger plate which is a movable between a first releasing position where the spring clutch is released and a second locking position where the spring clutch is locked, and wherein the handle is coupled to the trigger plate to move the trigger plate between the first releasing position and the second locking position.

36. The apparatus of claim 35, wherein the thigh section drive enabling/disabling mechanism includes including a release rod, a spring biasing the release rod against the trigger plate to hold the trigger plate in the first releasing position and a cable coupling the release rod to the handle, and wherein the actuation of the handle pulls the release rod away from the trigger plate to free the trigger plate to move to the second locking position.

37. The apparatus of claim 36, wherein the release rod includes two locking grooves corresponding to the two positions of the handle, wherein the thigh section drive locking mechanism includes a latch plate having a locking edge and a spring biasing the locking edge of the latch plate against the release rod into one of the two locking grooves in the release rod to prevent the release rod from moving when the back section is raised, and wherein the movement of the back section to the horizontal position displaces the latch plate in a direction disengaging the locking edge of the latch plate from the release rod and freeing the release rod.

38. The apparatus of claim 29, wherein thigh section drive enabling/disabling mechanism includes a handle coupled to the frame near the foot end of the patient support apparatus, and wherein the handle is movable between a first locking position on a first side of the patient support apparatus where the thigh section drive is coupled to the back section and a second releasing position on a second side of the patient support apparatus where the thigh section drive is decoupled from the back section.

39. The apparatus of claim 38, wherein the thigh section drive includes a linkage coupled to the thigh section and a spring clutch coupling the linkage to the back section.

40. The apparatus of claim 39, wherein the spring clutch includes a housing, a coil gripping spring received inside the housing and a connecting rod, wherein the spring clutch is lockable so that the gripping spring constricts around the connecting rod preventing the connecting rod from sliding relative to the clutch housing and the gripping spring to couple the back section to the linkage so that the thigh section is initially raised and then lowered as the back section is raised, and wherein the spring clutch is releasable so that the gripping spring loosens its grip on the connecting rod allowing the connecting rod to slide relative to the clutch housing and the gripping spring to decouple the back section from the linkage so that the back section can be raised and lowered without also raising and lowering the thigh section.

41. The apparatus of claim 40, wherein the spring clutch includes a trigger plate which is a movable between a first locking position where the spring clutch is locked and a second releasing position where the spring clutch is released, and wherein the handle is coupled to the trigger plate to move the trigger plate between the first locking position and the second releasing position.

42. The apparatus of claim 41, wherein the thigh section drive enabling/disabling mechanism includes a release rod coupled to the handle and a cable coupling the release rod to the trigger plate, and wherein the movement of the handle from the first locking position to the second releasing position pulls the release rod and the cable in a direction that moves the trigger plate to the second releasing position.

43. The apparatus of claim 42, wherein the release rod includes two locking grooves corresponding to the two positions of the handle, wherein the thigh section drive locking mechanism includes a latch plate having a locking edge and a spring biasing the locking edge of the latch plate into one of the two locking grooves in the release rod to prevent the release rod from moving when the back section is raised, and wherein the movement of the back section to the horizontal position displaces the latch plate in a direction disengaging the locking edge of the latch plate from the release rod and freeing the release rod.

44. The apparatus of claim 42, wherein the thigh section drive locking mechanism further includes a rocker arm coupled to the back section and a cable coupling the rocker arm to the latch plate, and wherein the movement of the back section to the horizontal position displaces the rocker arm in a direction that pulls the latch plate to free the release rod.

45. A patient support apparatus comprising:

a frame, a deck coupled to the frame, the deck including a back section that is pivotable relative to the frame and a thigh section that is pivotable relative to the frame, a lockable and releasable back section drive coupled to the back section, a lockable and releasable auto contour mechanism coupled to the back section and coupled to the thigh section, a first handle coupled to the back section and movable between a locking position locking the back section relative to the frame and a releasing position releasing the back section for pivoting movement relative to the frame, and a second handle coupled to the back section and movable between a coupling position coupling the auto contour mechanism to the back section and a decoupling position decoupling the auto contour mechanism from the back section.

46. The apparatus of claim 45, wherein the first and second handles are coupled to the back section near the head end of the patient support apparatus.

47. The apparatus of claim 45, wherein the back section drive includes a gas spring coupled to the back section, and wherein the first handle is a release bar coupled to the gas spring and coupled to the back section near the head end of the patient support apparatus.

48. The apparatus of claim 45, wherein the auto contour mechanism includes a linkage coupled to the thigh section and a spring clutch coupled to the linkage and coupled to the back section, and wherein the second handle comprises a pair of handles coupled to the spring clutch and coupled to the back section near the head end on opposite sides of the patient support apparatus.

49. A patient support apparatus comprising:

a frame, a deck coupled to the frame, the deck including a back section, a seat section and a thigh section, the back, seal and thigh sections being longitudinally spaced apart and transversely extending with at least the back and thigh sections being articulated relative to the frame, and a thigh section drive coupled to the back section and the thigh section to initially raise and then lower the thigh section as the back section is raised, the thigh section drive including a track coupled to the frame, and a track-engaging member movable along the track and coupled to the thigh section and coupled to the back section.

* * * * *